US010371479B2

(12) United States Patent
Hobson et al.

(10) Patent No.: US 10,371,479 B2
(45) Date of Patent: Aug. 6, 2019

(54) STABILIZED INTEGRATED COMMANDER'S WEAPON STATION FOR COMBAT ARMORED VEHICLE

(71) Applicant: Merrill Aviation, Inc., Saginaw, MI (US)

(72) Inventors: James C. Hobson, West Bloomfield, MI (US); Robert J. Huszti, Warren, MI (US)

(73) Assignee: Merrill Aviation, Inc., Saginaw, MI (US)

( * ) Notice: Subject to any disclaimer, the term of this patent is extended or adjusted under 35 U.S.C. 154(b) by 44 days.

(21) Appl. No.: 14/484,205

(22) Filed: Sep. 11, 2014

(65) Prior Publication Data

US 2015/0267989 A1 Sep. 24, 2015

Related U.S. Application Data

(60) Provisional application No. 61/876,486, filed on Sep. 11, 2013.

(51) Int. Cl.
*F41A 23/24* (2006.01)
*F41H 7/04* (2006.01)
(Continued)

(52) U.S. Cl.
CPC ..... *F41A 23/24* (2013.01); *F41A 27/24* (2013.01); *F41A 27/30* (2013.01); *F41H 7/04* (2013.01);
(Continued)

(58) Field of Classification Search
CPC ..... F41A 23/24; F41A 23/34; F41A 27/18; F41A 27/24; F41A 27/30; F41H 5/266; F41H 5/20; F41G 5/00
(Continued)

(56) References Cited

U.S. PATENT DOCUMENTS 376,985 A * 1/1888 Gruson ..... F41A 23/24 89/36.13
2,066,326 A * 1/1937 Brett ..... F41A 27/10 89/36.13

(Continued)

*Primary Examiner* — Joshua E Freeman
*Assistant Examiner* — Bridget A Cochran
(74) *Attorney, Agent, or Firm* — Bill Panagos; Linda Kennedy; Panagos Kennedy PLLC

(57) ABSTRACT

A weapon station includes a low profile adapter and rotating platform. The low profile adapter is mountable on numerous vehicles or structures, including armored combat vehicles, and mounted concentrically with an operator ingress and egress. The low profile adapter may be mountable on optical sights, such as periscopes. The rotating platform is mounted on the low profile adapter and concentric with the operator ingress and egress and is rotatable about an azimuth axis. The weapon station includes a weapon that can be fired in stabilized, power, and manual modes. The weapon can be fired from within the vehicle in stabilized and power modes, and an operator can fire the weapon manually without leaving the protection of the operator ingress and egress. The weapon station does not obstruct a line-of-sight through optical sights and affords an operator enhanced protection during combat engagements due to its ingress/egress-centric configuration.

20 Claims, 36 Drawing Sheets

(51) Int. Cl.

| | |
|---|---|
| ***F41A 27/24*** | (2006.01) |
| ***F41A 27/30*** | (2006.01) |
| *F41A 27/16* | (2006.01) |
| *F41G 3/16* | (2006.01) |
| *F41G 3/22* | (2006.01) |

(52) U.S. Cl.
CPC ..... *F41A 27/16* (2013.01); *F41G 3/165* (2013.01); *F41G 3/22* (2013.01)

(58) Field of Classification Search
USPC ..... 89/37.12
See application file for complete search history.

(56) References Cited

U.S. PATENT DOCUMENTS 2,366,410 A * 1/1945 Tharratt ..... F41A 23/24 359/401
2,519,129 A * 8/1950 Frise ..... F41A 23/24 89/33.14
2,569,571 A * 10/1951 Tear ..... F41G 5/00 89/41.09
2,660,794 A * 12/1953 Goertz ..... F41G 3/06 235/404
2,972,947 A * 2/1961 Fitzsimmons ..... F42B 5/295 102/465
2,976,769 A * 3/1961 Horn ..... F41A 23/24 89/36.14
3,024,704 A * 3/1962 Even ..... F41A 27/18 89/36.08
3,269,269 A * 8/1966 Kunze ..... F41A 23/24 89/36.08
3,355,987 A * 12/1967 Kunze ..... F41A 23/24 89/36.08
3,401,598 A * 9/1968 Sons, Jr. ..... F41A 23/20 89/38
3,575,085 A * 4/1971 McAdam, Jr. ..... F41G 3/065 235/404
3,602,088 A * 8/1971 Spring ..... F41A 9/34 359/402
3,800,659 A * 4/1974 Kuiper ..... F41A 23/20 89/1.802
3,866,514 A * 2/1975 Uhl ..... F41A 9/56 89/33.14
4,058,256 A * 11/1977 Hobson ..... A62C 27/00 239/101
4,294,749 A * 10/1981 Papenfuhs ..... C08K 5/0091 524/204
4,336,743 A * 6/1982 Horn ..... F41A 19/08 89/37.03
4,441,401 A * 4/1984 Hobson ..... F41A 27/30 89/36.13
4,501,190 A * 2/1985 Hobson ..... F41A 27/24 74/440
4,519,292 A * 5/1985 Kaustrater ..... F41A 27/10 89/36.13
4,574,685 A * 3/1986 Sanborn ..... F41A 23/34 89/36.13
4,601,230 A * 7/1986 LeBlanc ..... F41A 19/10 89/1.2
4,616,127 A * 10/1986 Whiting ..... F41G 5/14 235/411
4,924,749 A * 5/1990 Beyer ..... F41G 5/16 235/407
5,036,748 A * 8/1991 Pendry ..... F41A 23/24 342/67
5,128,803 A * 7/1992 Sprafke ..... F41G 1/40 359/402
5,220,127 A * 6/1993 Tiomkin ..... F41A 19/08 89/36.14
5,280,889 A * 1/1994 Amil ..... F16F 1/02 248/618
5,311,807 A * 5/1994 Ruttgerodt ..... F41A 23/24 89/36.08
5,949,015 A * 9/1999 Smith ..... F41G 3/22 89/41.05
6,012,376 A * 1/2000 Hanke ..... F41G 3/22 359/683
6,285,934 B1 * 9/2001 Shaw ..... B60K 15/0406 220/203.24
6,886,447 B2 * 5/2005 Crotty ..... F41H 5/223 89/36.12
7,030,579 B1 * 4/2006 Schmitz ..... F41A 23/24 318/139
7,185,575 B1 * 3/2007 Collier ..... F41A 23/24 89/1.8
7,210,391 B2 * 5/2007 Beckmann ..... F41A 27/12 89/37.03
7,325,475 B2 * 2/2008 Long ..... B60P 1/6445 296/181.7
7,478,580 B1 * 1/2009 Parimi ..... F41H 5/013 89/36.07
7,821,706 B2 * 10/2010 Bellandi ..... G02B 23/08 359/399
7,942,092 B1 * 5/2011 Kiel ..... F41H 5/16 89/36.08
8,393,258 B2 * 3/2013 Cazalieres ..... F41A 23/20 89/1.804
8,402,877 B1 * 3/2013 Petrosillo ..... F41H 5/013 89/36.03
8,434,395 B1 * 5/2013 Petrosillo ..... F41H 5/06 89/36.01
8,607,686 B2 * 12/2013 McKee ..... F41A 27/20 89/41.01
8,646,374 B2 * 2/2014 Shacklee ..... F41A 23/24 89/41.02
8,833,232 B1 * 9/2014 Fox ..... F41A 27/18 89/41.06
8,839,708 B2 * 9/2014 Chiappini ..... F41A 9/82 89/36.13
8,910,559 B1 * 12/2014 Berman ..... F41H 5/263 89/36.08
8,930,066 B2 * 1/2015 McKee ..... F41A 27/20 700/83
9,032,855 B1 * 5/2015 Foren ..... F42B 33/00 102/466
9,146,081 B2 * 9/2015 Chu ..... F41H 5/013
9,194,664 B1 * 11/2015 Smith ..... F41H 5/20
9,328,986 B1 * 5/2016 Pennau ..... F41A 23/20
2003/0089220 A1 * 5/2003 Boudreau ..... F41A 23/42 89/1.815
2003/0136253 A1 * 7/2003 Moser ..... F41G 1/00 89/41.17
2004/0134340 A1 * 7/2004 Quinn ..... F41A 27/28 89/41.01
2005/0252367 A1 * 11/2005 Jilg ..... F41H 5/26 89/36.14
2006/0219094 A1 * 10/2006 Padan ..... B64D 7/06 89/37.16
2007/0119296 A1 * 5/2007 Niv ..... F41A 23/20 89/37.02
2008/0034954 A1 * 2/2008 Grober ..... F41A 23/14 89/41.05
2009/0120274 A1 * 5/2009 Schneider ..... F41H 5/20 89/36.08
2011/0023698 A1 * 2/2011 Hayden ..... F41A 27/28 89/41.02
2011/0197747 A1 * 8/2011 Schneider ..... F41H 5/013 89/36.08
2012/0024143 A1 * 2/2012 Shacklee ..... F41A 23/24 89/41.02
2012/0247317 A1 * 10/2012 Karakookly ..... F41A 23/24 89/127
2013/0145925 A1 * 6/2013 Lorenz ..... F41A 23/24 89/36.13
2013/0220109 A1 * 8/2013 Berkovich ..... F41H 5/20 89/36.13

(56) References Cited

U.S. PATENT DOCUMENTS

| | | | | |
|---|---|---|---|---|
| 2014/0230641 | A1* | 8/2014 | Isola | F41A 23/20 89/37.17 |
| 2015/0082977 | A1* | 3/2015 | Tikochinski | F42B 5/145 89/41.01 |
| 2016/0010940 | A1* | 1/2016 | Horvath | F41A 23/24 89/41.02 |
| 2016/0025435 | A1* | 1/2016 | Lung | F41A 9/29 89/37.15 |
| 2016/0025441 | A1* | 1/2016 | Lung | F41A 9/79 89/37.07 |

* cited by examiner

STABILIZED INTEGRATED COMMANDER'S WEAPON STATION FOR COMBAT ARMORED VEHICLE

RELATED APPLICATION

This application claims the benefit under 35 U.S.C. § 119 (e) of U.S. Provisional Application Ser. No. 61/876,486, filed Sep. 11, 2013, entitled "Stabilized Integrated Commander's Weapon Station for Combat Armored Vehicle," incorporated herein by reference in its entirety.

TECHNICAL FIELD

Combat vehicles, such as armored combat vehicles and armored personnel carriers, have become a mainstay of armed forces ground operations. Such vehicles must be maneuverable, versatile and effective if the mission is to be accomplished.

Part of the vehicle's effectiveness is in how its weapon systems operate, and how the weapon systems affect the vehicle profile or silhouette. It is far more difficult to detect and neutralize a low profile, low silhouette vehicle than it is to neutralize a vehicle that does not enjoy such advantages. Higher profile or silhouette vehicles are seen from a greater distance and require a greater amount of cover than a lower profile or silhouette vehicle. These disadvantages allow enemy fire to be more effective against such higher profile, higher silhouette vehicles.

Another aspect of combat vehicle design is how well the weapon systems are integrated into the design of the vehicle and whether that integration allows or facilitates operation of the weapon system from within the protection of the vehicle. This consideration requires that the line-of-sight (LOS) between the targets and the weapon station be clear so that an operator within the vehicle may sight the targets and control the fire from the weapon station entirely from within the vehicle and not have to emerge from the vehicle in order to sight the target to be eliminated. In addition, the base upon which the weapon system is to be mounted should be stiff and provide ballistic protection for stationary periscope units and azimuth ring bearing and stationary ring gear. This consideration is especially important when accessorizing existing vehicles with aftermarket weapon stations, or alternatively producing new vehicles with weapon stations that include such advantages. Several problems present themselves for solution, among them are where the weapon station should be mounted on the vehicle; in what manner will it be mounted; how will it affect existing weapon systems, if any; and will there be an effective LOS from within the vehicle to a target.

There is a need for a weapon station that meets all the needs enumerated above.

DETAILED DESCRIPTION

Turning now to the drawings, wherein like numerals reference like structures, multiple embodiments of a SICWS 2 are described. Although the SICWS 2 may be illustrated and described herein as including particular components in a particular configuration, the components and configuration shown and described are provided for example purposes only. Herein the term "elevation" refers to a vertical direction of a given object relative to a horizon. The term "azimuth" refers to a horizontal direction of a given object relative to a reference direction, such as a forward facing direction F. The term "concentric" refers to two shapes having a common center or center point. Any number of shapes could be deemed concentric so long as they meet the definition above. For example, an octagon could be concentric with a circle, so long as they share the same center point.

Figure 1:
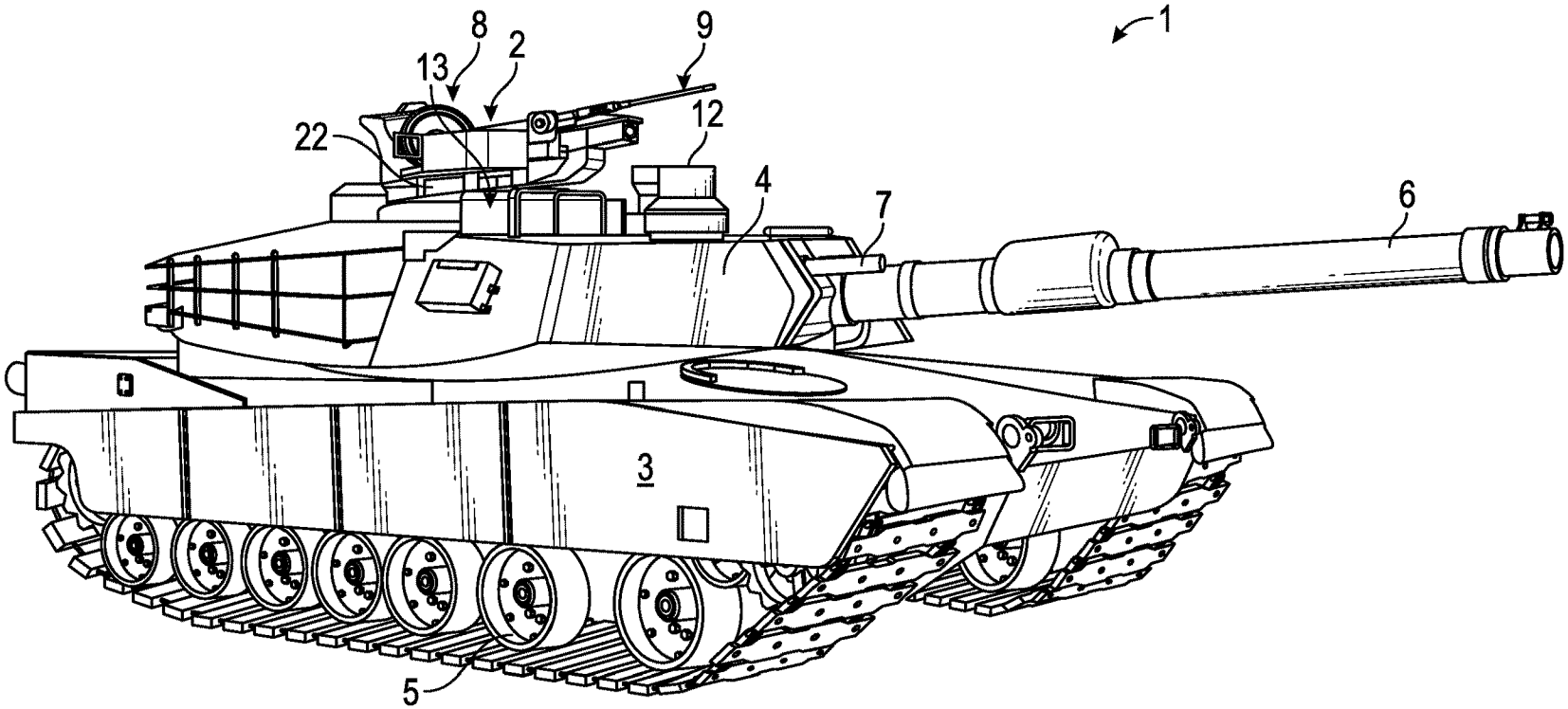
FIG. 1 is a perspective view of an armored combat vehicle illustrating one embodiment of the stabilized integrated commander's weapon station (SICWS)

FIG. 1 is a perspective view of an armored combat vehicle 1 illustrating one embodiment of the SICWS 2. The exemplary armored combat vehicle 1 shown in FIG. 1, an M1A2 Abrams Main Battle Tank, is just one of many vehicles or structures suitable for the SICWS 2 and its equivalents. For example, embodiments of the SICWS 2 may be fit on an M2A2 Bradley Infantry Fighting Vehicle, or even a stationary structure.

The armored combat vehicle 1 includes a turret 4 that is mounted on a hull 3. In this example, the armored combat vehicle 1 is typically operated by a crew of four members, including a commander, gunner, loader, and driver. Three of the crew members, the commander, gunner, and loader, perform their respective roles from within the turret 4. The driver drives the armored combat vehicle 1 from within the hull 3. The hull 3 includes a drivetrain comprised of tracked wheels 5. The turret 4 includes a main gun 6, which can be a M256 120 mm smooth bore cannon. The gunner fires the main gun 6 and views targets through the gunner's primary sight 13. The turret 4 is designed to rotate or pivot about the hull 3, allowing the armored combat vehicle's 1 main gun 6 to be aimed at targets without repositioning of the hull 3. The armored combat vehicle 1 also includes a coaxial machine gun 7 located coaxially and proximally with the main gun 6. The coaxial machine gun 7 can be a 7.62 M240 machine gun. Additionally, there is a loader's weapon 11 mounted proximally with loader's hatch 10. The loader's weapon 11 can also be a 7.62 M240 machine gun. The SICWS 2 may be mounted adjacent to the loader's hatch 10 atop the turret 4, and includes a commander's weapon 9, which can be a .50 caliber M2 machine gun.

Figure 2:
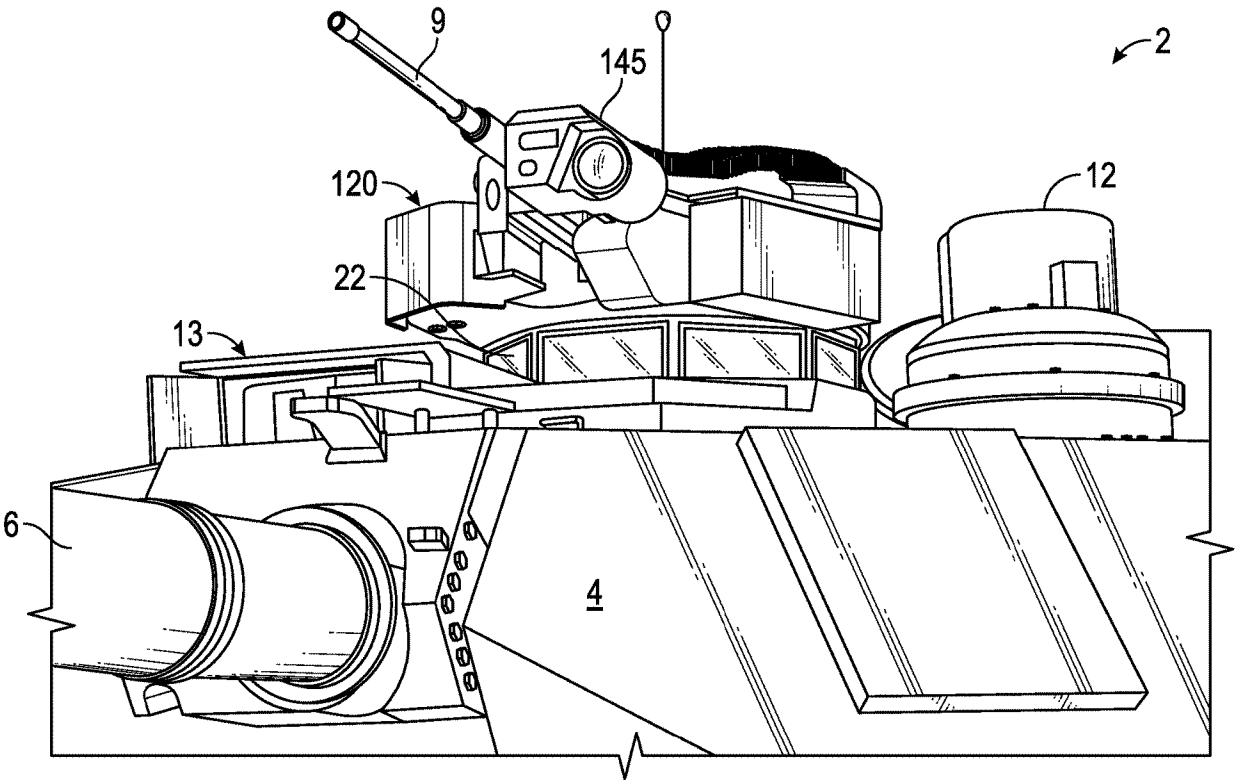
FIG. 2 is a perspective view of the SICWS mounted in a hatch-centric configuration.
Figure 33:
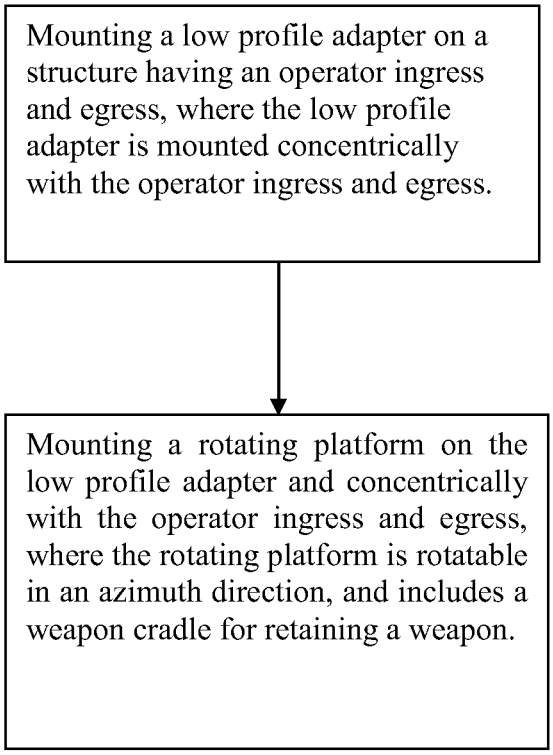
FIG. 33 is a flow chart depicting a method for mounting an exemplary weapon station on a structure.

The benefits of the SICWS's 2 hatch-centric configuration will hereinafter be described. Referring now to FIG. 2, the SICWS 2 is shown mounted in a hatch-centric configuration. The SICWS 2 is integrated or "built in" for optimal compatibility with existing vehicle interfaces and features, including the vehicle structure, the commander's hatch 8, and vision provisions. The SICWS 2 is integrally mounted to the turret 4 above an existing circular array of fixed periscopes 22 and does not obstruct vision through them. As can be seen in FIG. 2, none of the eight existing periscopes 22 are obstructed by the SICWS 2. This integrated design approach is a significant advance compared to weapon stations that "bolt on" to a vehicle but which typically obstruct vision, compromising overall operational capabilities and importantly, the commander's situational awareness. FIG. 33 depicts a method for mounting an exemplary weapon station having a hatch-centric configuration on a structure.

Figure 3:
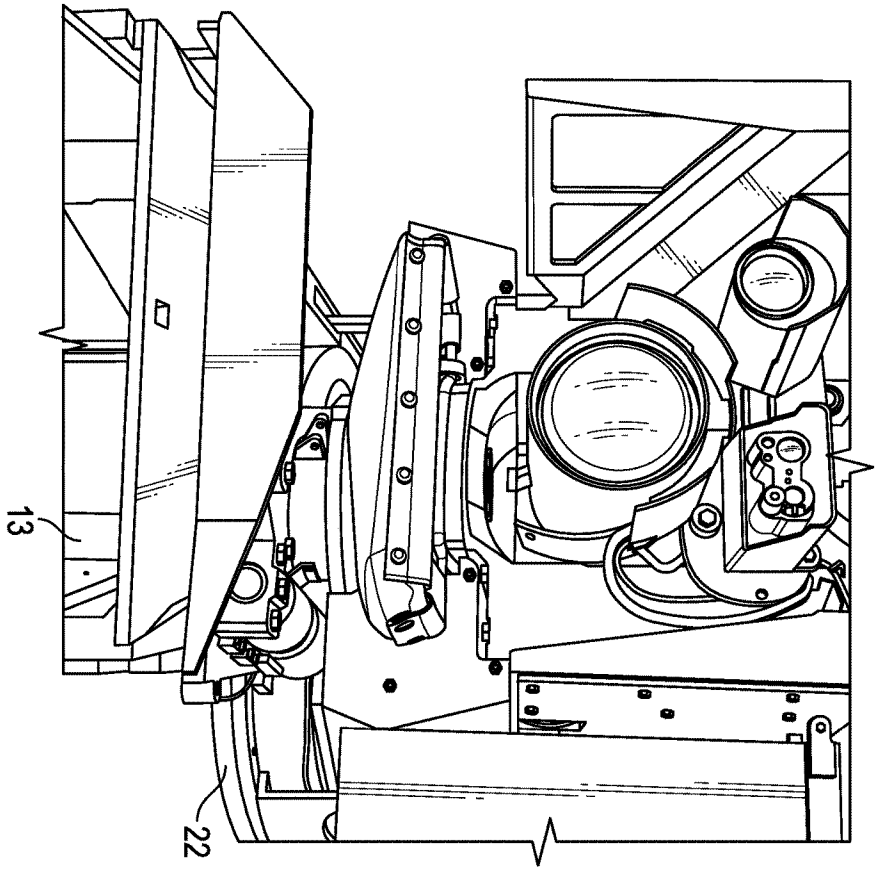
FIG. 3 is a perspective view of a "bolt on" version of an existing Common Remotely Operated Weapon Station (CROWS) that obstructs the view of existing vehicle periscopes.
Figure 8:
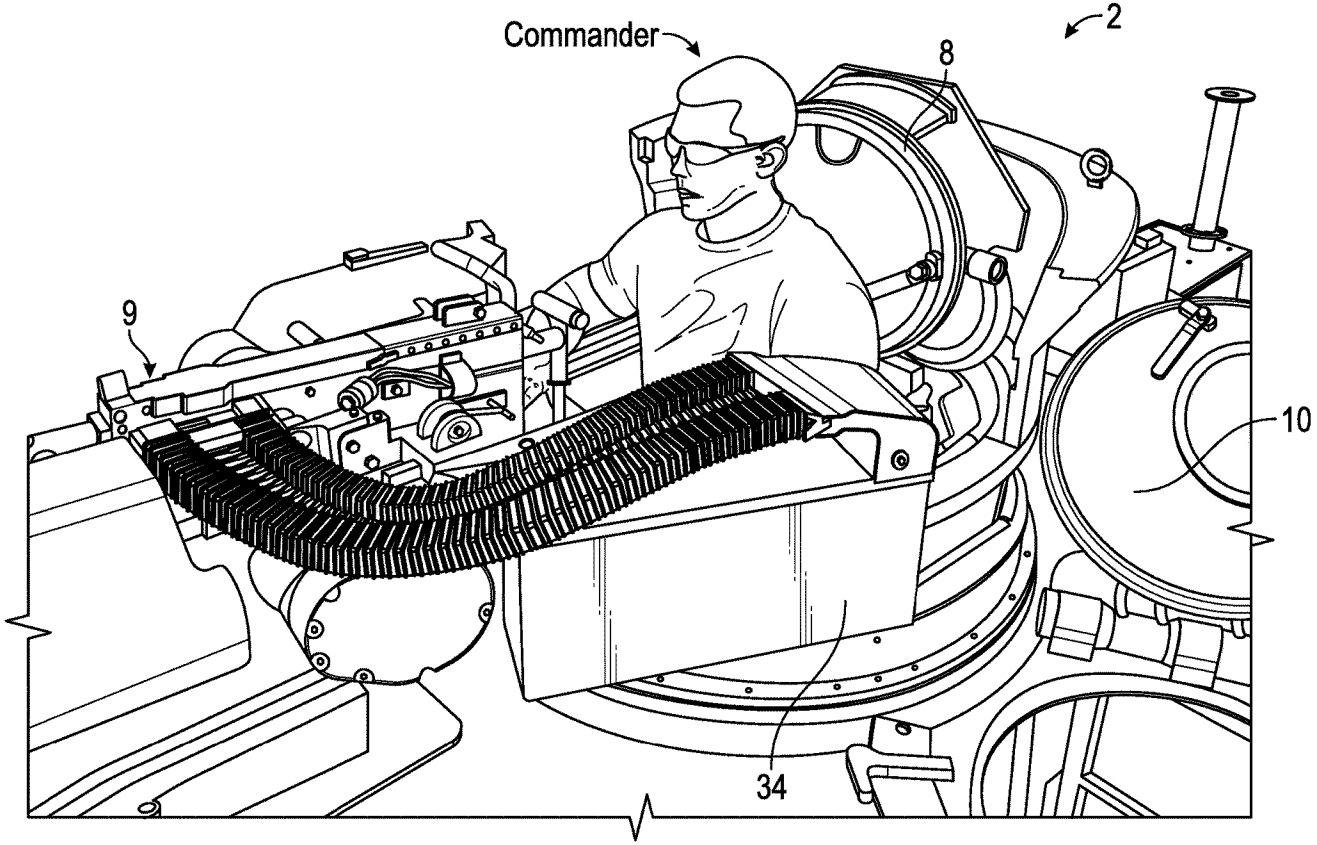
FIG. 8 is a perspective view of one embodiment of the SICWS 2 where a commander (operator) has opened the commander's hatch and is firing the commander's weapon from an operator ingress and egress while the commander's torso is protected from hostile fire.

FIG. 3 shows a "bolt on" version of a commander's weapon station that obstructs the LOS through existing periscopes 22. The "bolt on" version is mounted on top of the gunner's primary sight 13, which is located forward of the commander's hatch 8. Thus, the "bolt on" version is not mounted concentrically with the commander's hatch 8. As can be seen in FIG. 3, the existing periscopes are obstructed by the forward mounted "bolt on" commander's weapon station. On the other hand, the SICWS's 2 design satisfies the long-felt need of a commander's weapon station that does not obstruct a commander's views, whether it is through the array of periscopes 22 or optical equipment, such as the Commander's Independent Thermal Viewer (CITV) 12. Additionally, there is minimal obstruction of forward vision when the commander's hatch 8 is opened and the commander is prepared to fire the commander's weapon 9 in a fire-ready, hatch-centric position, as shown in FIG. 8.

Figure 4A:
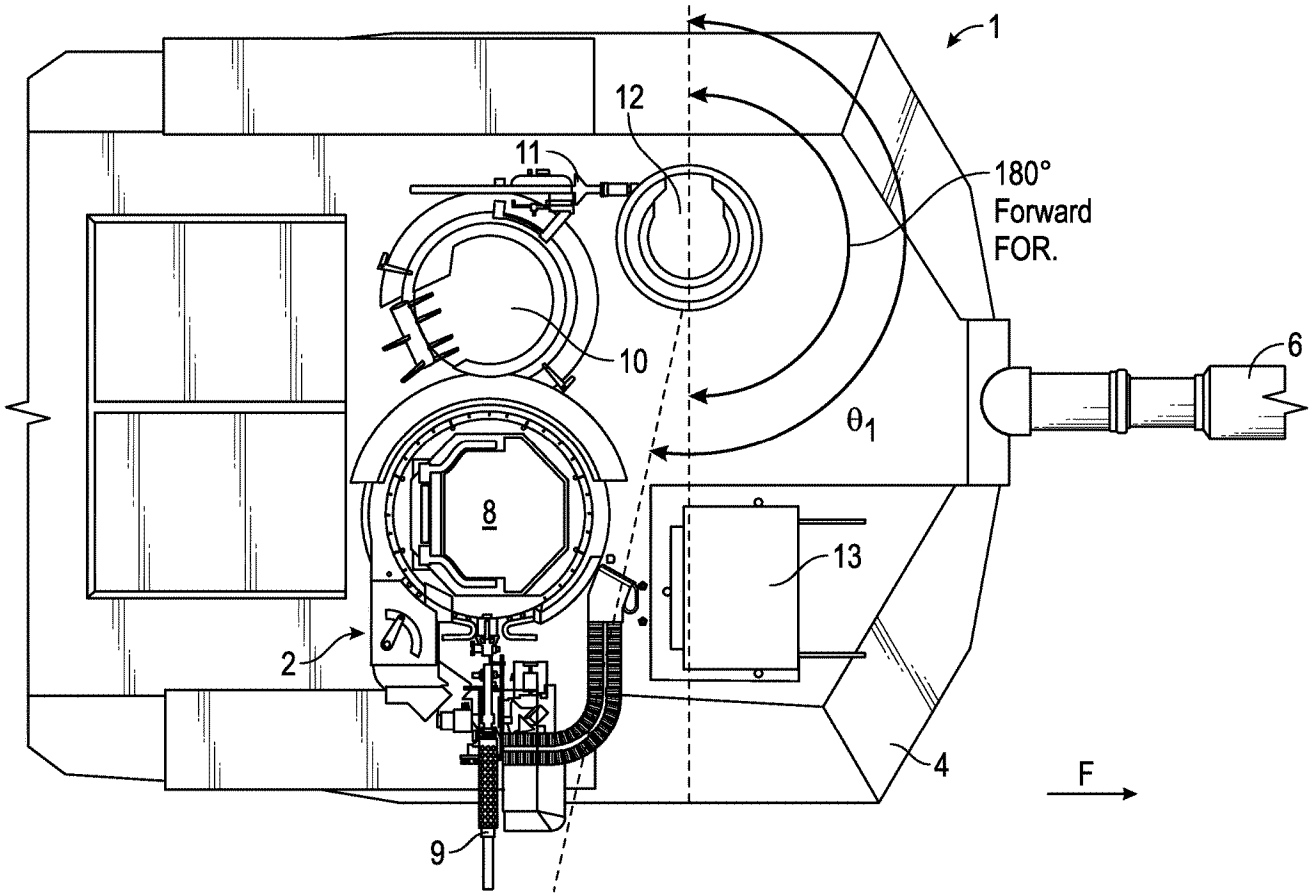
FIG. 4A is a top view of the armored combat vehicle's turret that includes one embodiment of the SICWS.
Figure 4B:
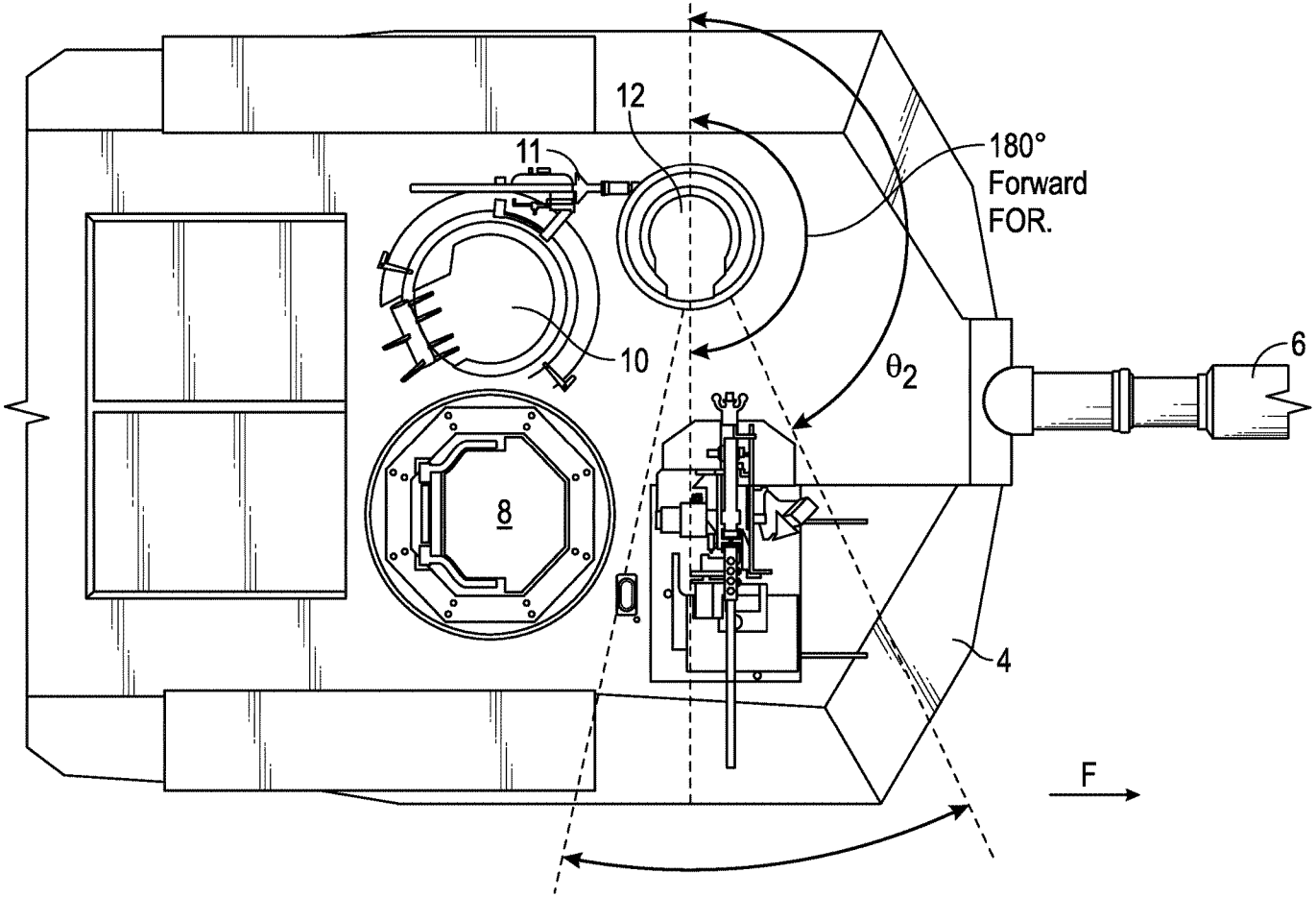
FIG. 4B is a top view of an armored combat vehicle that includes a "bolted on" version of a commander's weapon station.

When FIGS. 4A and 4B are compared, the advantage of the SICWS's 2 hatch-centric configuration is apparent. FIG. 4A is a top view of the armored combat vehicle's 1 turret 4 that includes one embodiment of the SICWS 2. The forward direction of the armored combat vehicle 1 is denoted by forward facing direction F. The SICWS 2 is shown mounted concentrically on the commander's hatch 8. Forward of the commander's hatch 8 is the gunner's primary sight 13. The height of the gunner's primary sight does not obstruct vision through the existing periscopes 22 or the CITV 12. Adjacent to the commander's hatch 8 and SICWS 2 is the loader's hatch 10. The loader's weapon 11 is also shown. Forward of the loader's hatch 10 is the CITV 12, an important optical sight that may include forward looking infrared (FLIR) capabilities, allowing the commander to scan for targets in both day and night situations, tough weather conditions, and through manmade obscurants, such as smoke. The CITV 12 provides the armored combat vehicle 1 with hunter capabilities, making the armored combat vehicle 1 a true hunter-killer vehicle. The CITV 12 is able to rotate in azimuth directions, or about an axis that is perpendicular to the roof of the turret 4. Additionally, the CITV typically provides for an elevation range of viewing.

If the CITV is pointed directly in a forward direction F, the dashed lines in FIG. 4A represent a 180 degree forward field of regard. In this context, the field of regard (FOR) is defined as the total angular area that the CITV can view by slewing azimuth right or azimuth left. The goal is to provide a commander's weapon station that does not obstruct views in this area; the SICWS 2 accomplishes this feat. If the commander wishes to scan for targets directly to the right of the armored combat vehicle 1, the commander may rotate the CITV 12 azimuth right, or toward the SICWS 2. If the commander's weapon 9 is facing a forward direction F, or toward the main gun 6, the commander's weapon 9 may obstruct the view of the CITV 12. To avoid this obstruction, the CITV 12 may communicate with the SICWS 2 such that their movements are synchronized. Meaning, the SICWS 2 can be rotated about in a right azimuth direction so that the FOR of the CITV 12 is not obstructed by the SICWS 2. FIG. 4A illustrates how the SICWS 2 can be rotated to expand the FOR of the CITV 12 such that the 180 degree forward field of regard is not obstructed. Moreover, the SICWS 2 can be maneuvered to permit views through the CITV greater than the 180 degree forward field of regard (in an azimuth right direction), denoted by FOR angle $\theta_1$.

FIG. 4B is a top view of an armored combat vehicle 1 that includes a "bolt on" version of a commander's weapon station, which is commonly referred to as a Common Remotely Operated Weapon Station (CROWS). The CROWS is shown mounted on the gunner's primary sight 13 and forward of the commander's hatch 8. Thus, the CROWS is not mounted in a hatch-centric configuration. Because the CROWS is bolted onto the gunner's primary sight 13, it obstructs the commander's LOS through both the CITV 12 and the existing periscopes 22. As shown in FIG. 4B, the CITV 12 only has a FOR of angle $\theta_2$ with respect to the 180 degree forward FOR. Angle $\theta_2$ is less than 180 degrees. In other words, the CROWS obstructs the commander's views through the 180 degree forward field of regard. In comparison, where the SICWS 2 is mounted instead of the CROWS as shown in FIG. 4A, the CITV 12 is not obstructed in the 180 degree forward field of regard and has a FOR of $\theta_1$, an angle greater than 180 degrees. Thus, the hatch-centric configuration of the SICWS 2 has a distinct advantage over the forward mounted CROWS; an armored combat vehicle 1 mounted with a SICWS 2 permits a CITV to have a 180 forward FOR, whereas an armored combat vehicle 1 that has a forward mounted CROWS does not permit a CITV 12 to have a 180 degree forward FOR.

Figure 5:
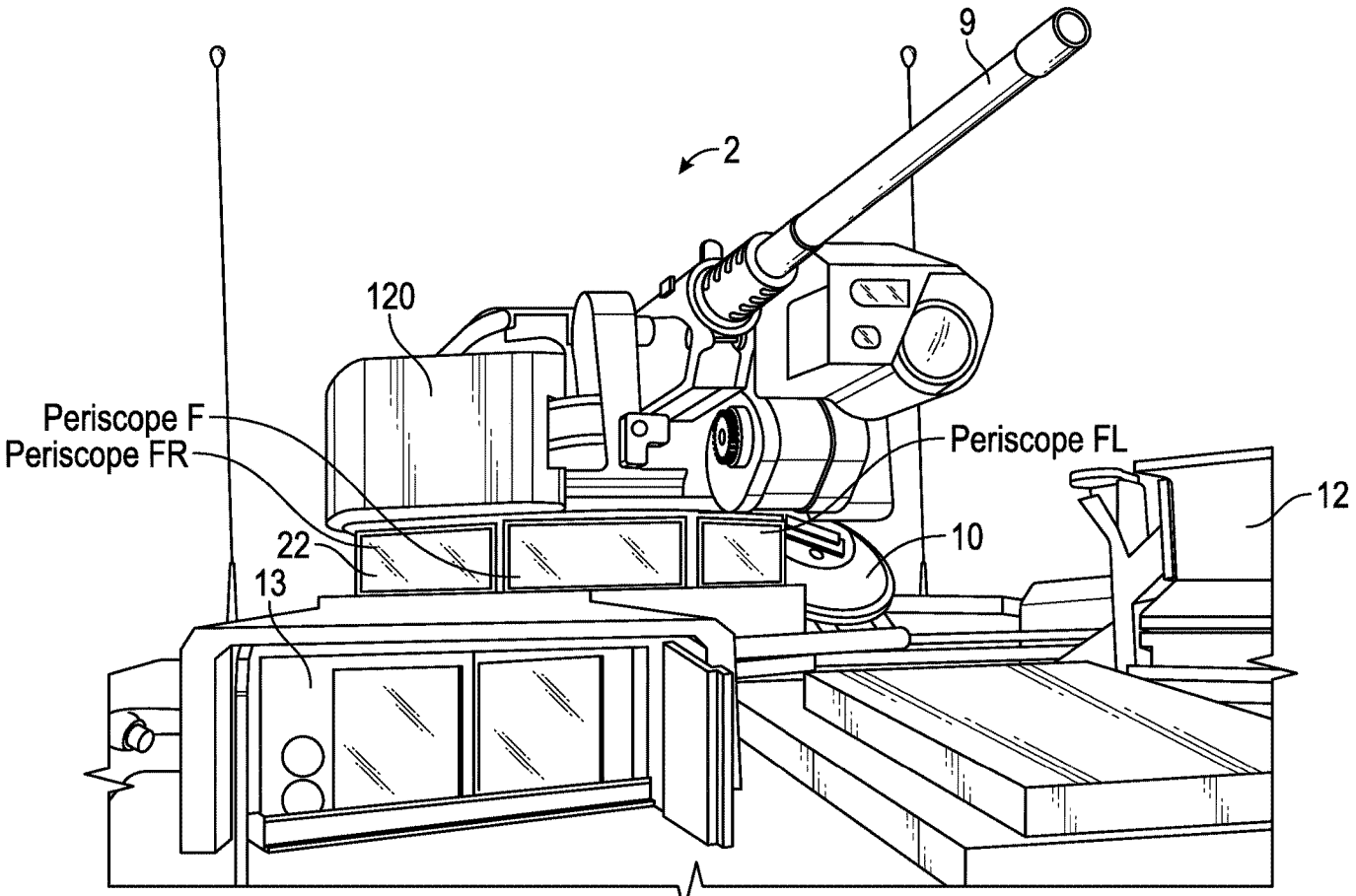
FIG. 5 is a perspective view of the clear LOS through the three front-facing periscopes of the armored combat vehicle.

FIG. 5 illustrates the clear LOS through the three front-facing periscopes of the existing periscopes 22. The front right periscope FR, the front periscope F, and the front left FL periscopes are shown unobstructed, due to the SICWS's 2 hatch-centric configuration with the commander's hatch 8.

Figure 6A:
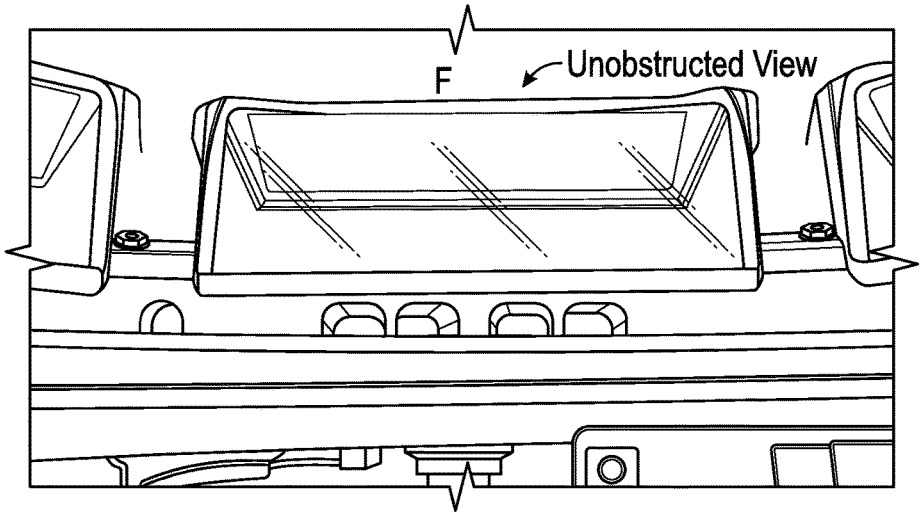
FIG. 6A shows a view through front periscope F where a SICWS 2 is mounted concentrically with the commander's hatch.
Figure 6B:
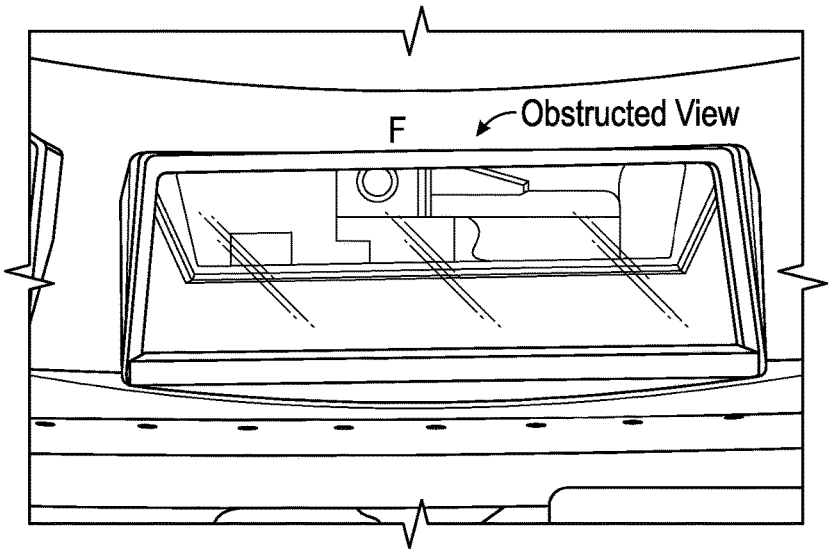
FIG. 6B shows a view from within the armored combat vehicle through front periscope F where a CROWS has been mounted on top of the gunner's primary sight structure.

To further illustrate the obstruction to a commander's sight caused by the CROWS's forward mounting position, FIG. 6B shows a view through front periscope F where a CROWS has been mounted on top of the gunner's primary sight 13. As can be seen, the CROWS obstructs more than half of the view through front periscope F. In comparison, FIG. 6A shows a view through front periscope F where a SICWS 2 has been mounted concentrically with the commander's hatch 8. As can be seen, the commander has an unobstructed view through front facing periscope F, or a maximum field of view (FOV).

Figure 7A:
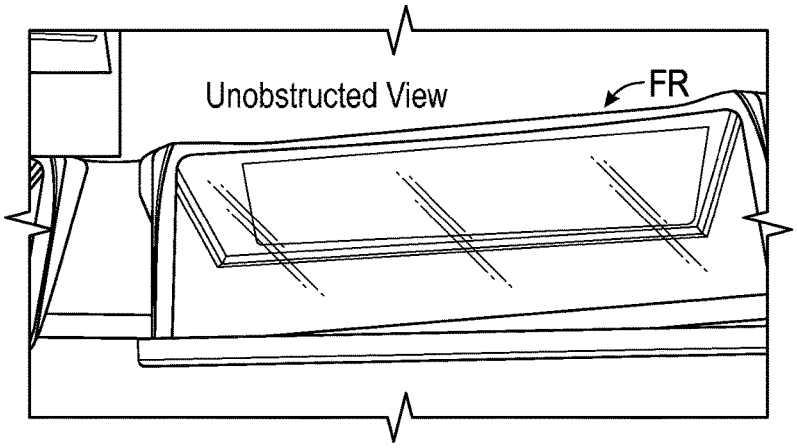
FIG. 7A shows a view from within the armored combat vehicle through front right periscope FR where a SICWS 2 is mounted concentrically with the commander's hatch.
Figure 7B:
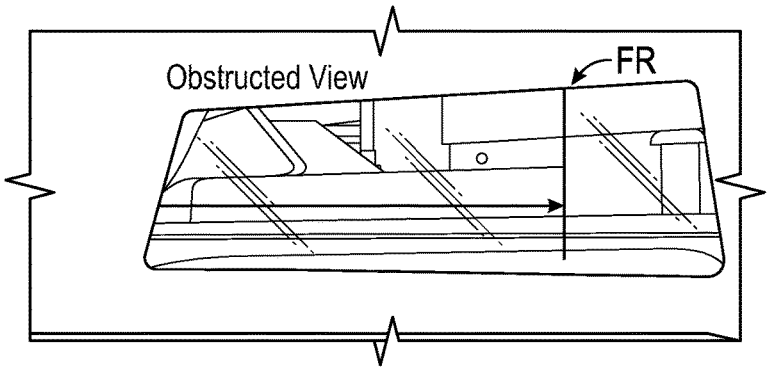
FIG. 7B shows a view through front right periscope FR where a CROWS has been mounted on top of the gunner's primary sight.

FIG. 7B shows a view through front right periscope FR where a CROWS has been mounted on top of the gunner's primary sight 13. The CROWS's support bracket is shown obstructing the FOV through periscope FR. In comparison, FIG. 7A shows a view through front right periscope FR where a SICWS 2 has been mounted concentrically with the commander's hatch 8. As can be seen, the commander has an unobstructed view from front right facing periscope F. As demonstrated by the preceding figures, the SICWS 2 has the distinct advantage of not interfering with or obstructing any existing optical equipment, including the CITV 12 and existing periscopes 22.

Referring now to FIG. 8, an additional advantage of the hatch-centric configuration of the SICWS 2 is shown. Due to the SICWS's 2 hatch-centric configuration, the commander (operator) may open the overhead hatch and use the commander's weapon 9 while his or her torso is protected within the crew compartment, as shown in FIG. 8. In other words, the operator of the commander's weapon 9 is firing the gun from an operator ingress and egress position. As the CROWS and other prior weapon systems are not hatch centric, the commander is required to leave the vehicle compartment and become fully exposed to hostile fire.

FIG. 8 also illustrates that the silhouette of the SICWS 2 is no higher than the commander's hatch 8 when it is fully opened. Thus, the original silhouette of the armored combat vehicle 1 can be maintained, even with the mounting of the SICWS 2. An armored combat vehicle 1 mounted with a low profile SICWS 2 makes it more difficult for enemies to detect, recognize, and identify it compared to other armored combat vehicles 1 mounted with weapon stations that typically have higher silhouettes than the commander's hatch 8 when it is fully opened. As enemies can generally detect, recognize, and identify higher silhouettes vehicles much faster than low silhouette vehicles, low silhouette vehicles are more effective and survivable on the field of battle.

Figure 9:
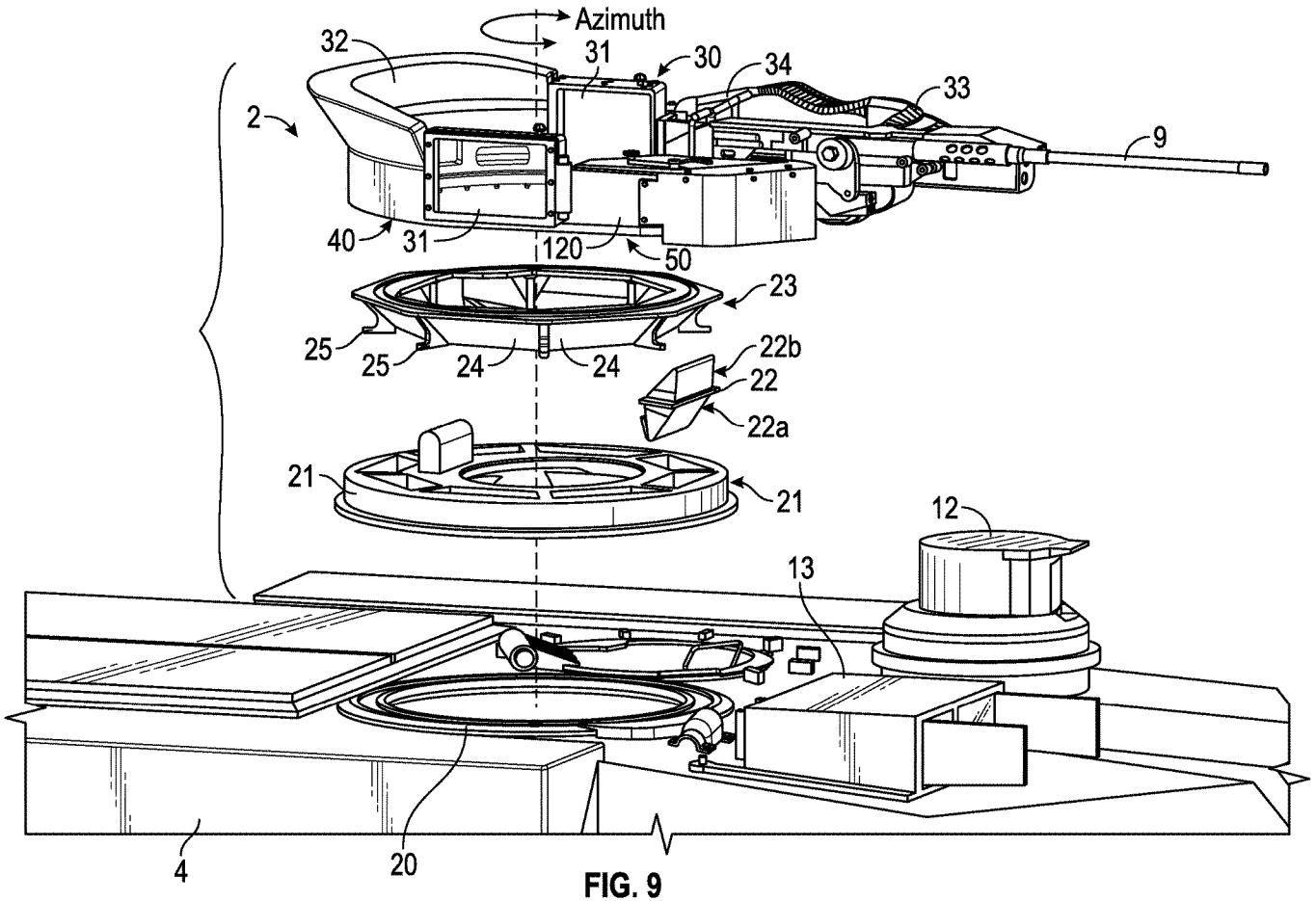
FIG. 9 is an exploded schematic representation of one embodiment of a stabilized integrated commander's weapon station.

Next, components of the SICWS 2 will be described. FIG. 9 is an exploded schematic representation of one embodiment of the SICWS 2. The parts of the SICWS assembly 2 shown in FIG. 9 include an operator ingress and egress 20, an existing base housing 21, existing vehicle periscopes 22, a low profile adapter 23, and a SICWS rotating platform 30.

The SICWS assembly 2 is integrally mounted on the roof of the turret 4 and concentrically with the existing operator ingress and egress 20. The operator ingress and egress 20 could be the same location or opening, as shown in FIG. 9. In this example, the operator ingress and egress 20 supports the commander's hatch 8. One of ordinary skill in the art would appreciate that the SICWS 2 and its derivatives could be integrated on other structures or vehicle openings, such as on the loader's hatch 10 of the armored combat vehicle 1 described herein, or on other combat vehicles such as Light Armored Vehicles (LAV), Mine-Resistant Ambush Protected vehicles (MRAP), or the like.

One embodiment of the SICWS 2 integrates the existing base housing 21 into its design. The existing base housing 21 holds or supports eight existing vehicle periscopes 22 in place octagonally along its perimeter, providing the commander with a 360 degree view of the battlefield. The 360 degree peripheral vision greatly improves the commander's situational awareness, ability to develop tactical strategies, effectively engage targets, and direct vehicle operations and maneuvers to the crew members. Obstruction to this 360 degree view may greatly impair the success of a mission and place the crew members at a greater risk of harm.

Utilizing the existing base housing 21 and existing vehicle periscopes 22 has significant design and practical advantages. First, as noted earlier, integrating the existing base housing 21 and the existing vehicle periscopes 22 into the design permits the SICWS 2 to be mounted in a hatch-centric configuration. Second, the use of the existing components maintains the functionality of the legacy hatch. Third, the amount of parts and the machining of additional parts are minimized. Fourth, the existing base housing 21 and existing vehicle periscopes 22 found on armored combat vehicles 1, such as the M1A2 Abrams Main Battle Tank, typically undergo rigorous ballistic testing. Thus, use of existing components maintains as much as possible an approved ballistic envelope and minimizes the need for ballistic testing on additional components.

Referring still to FIG. 9, the low profile adapter 23 is shown as a high stiffness base for support that is readily mounted on top of the existing base housing 21. Although the low profile adapter is shown configured to adapt to the existing base housing 21 shown in FIG. 9, low profile adapter 23 could be of varying designs and configurations such that it could be mounted on any number of base housings, or even to a roof or structure without a base housing at all.

In this example, the low profile adapter 23 retains and provides ballistic protection for the existing vehicle periscopes 22 and provides a mounting base for stationary azimuth ring gear 40. The low profile adapter 23 facilitates installation without vehicle modification, and results in a very stiff base structure, enhancing the stabilized aiming accuracy when the commander's weapon 9 is fired in dynamic situations. It also helps minimize the overall height of the vehicle. The low profile adapter has low overall height, or a low silhouette, is a significant advantage in combat environments as it makes the vehicle less detectable to the enemy.

The low profile adapter 23 is mounted onto the existing base housing 21, and fits integrally with the existing vehicle periscopes 22. Specifically, the existing base housing 21 holds the base portions 22*a* of the existing vehicle periscopes 22 in place, and when the low profile adapter 23 is mounted on the existing base housing 21, each angled segmented structure 24 of the low profile adapter 23 is angled to mate with the angled upper portion 22*b* of each of the existing vehicle periscopes 22. The mating of the low profile adapter 23 with the existing base housing 21 helps the vehicle maintain a low profile, protects the periscopes 22, and provides the commander with an unobstructed 360 degree peripheral view, a feat that others have failed to accomplish.

Figure 10:
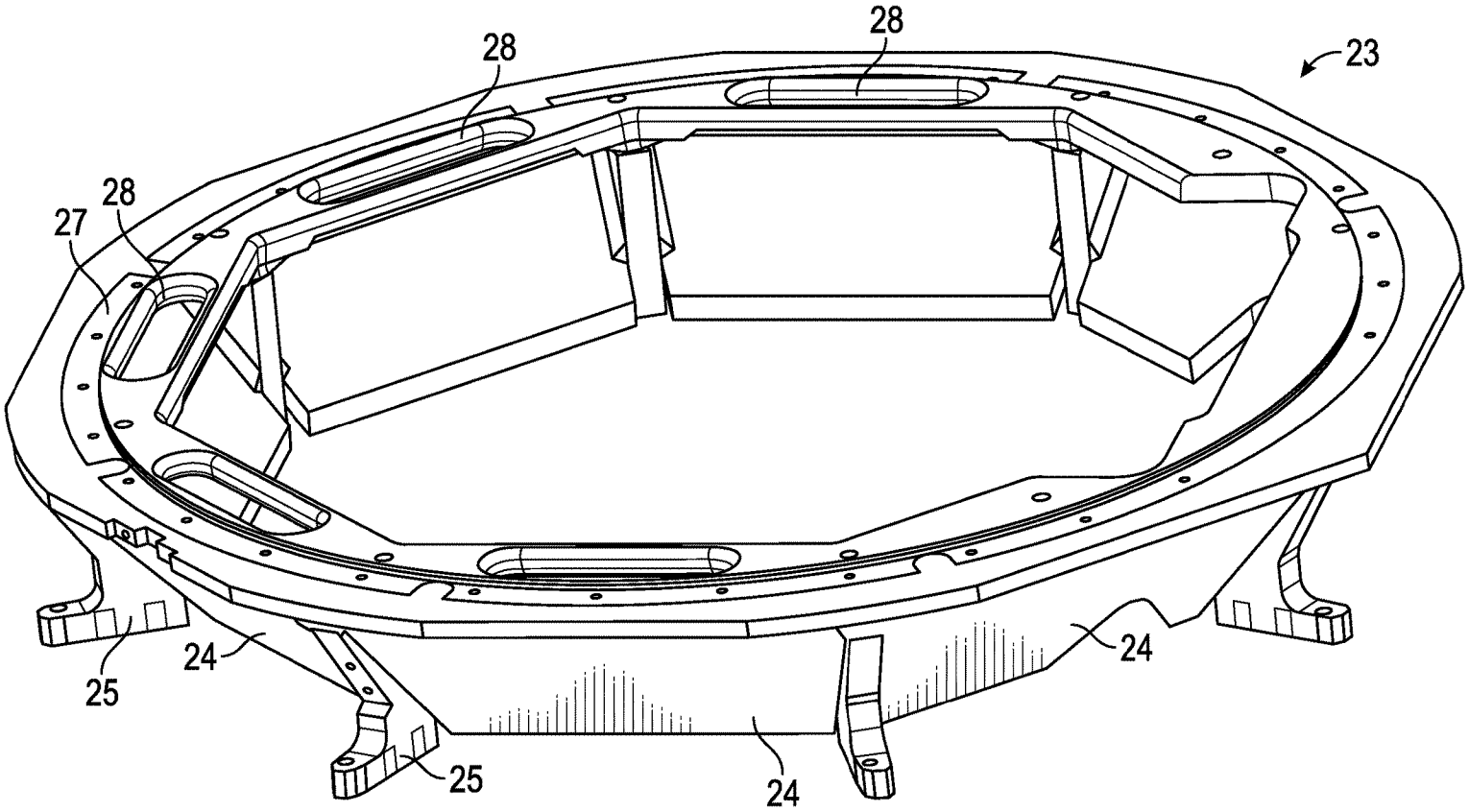
FIG. 10 is a perspective drawing of the low profile adapter of one embodiment of the stabilized integrated commander's weapon station.

Referring to FIG. 10, a perspective drawing of the low profile adapter 23 provides more detail. The angled segmented structures 24 of the low profile adapter 23 are shown separated by flat underside surface mounts 25. To mount the low profile adapter 23 onto the existing base housing 21, the flat underside surface mounts 25 are aligned with existing threaded attachment holes 26 located on the existing base housing 21. In this example, screws (not shown) are threaded into the existing threaded attachment holes 26 (not shown) to secure the low profile adapter 23 onto the existing base housing 21. Of course, the integrated existing base housing 21 and low profile adapter 23 are mounted concentrically with the operator ingress and egress 20.

The low profile adapter 23 includes a mounting surface 27 atop its structure. Adjacent to the mounting surface 27 are multiple hand grips 28. The hand grips 28 assist the commander with ingress and egress from the commander's hatch 8. The mounting surface 27 provides a surface for the stationary azimuth ring gear 40 to be mounted. The stationary azimuth ring gear 40 (not shown in FIG. 10) is mounted onto the mounting surface 27 by threaded bolts (not shown). The stationary azimuth ring gear 40 is an external ring gear, meaning the gear teeth 41 are formed on the outer rim of the gear, or its outer circumferential periphery 42. The gear teeth 41 of the stationary azimuth ring gear 40 are designed to mesh with azimuth output pinion 50.

Figure 11:
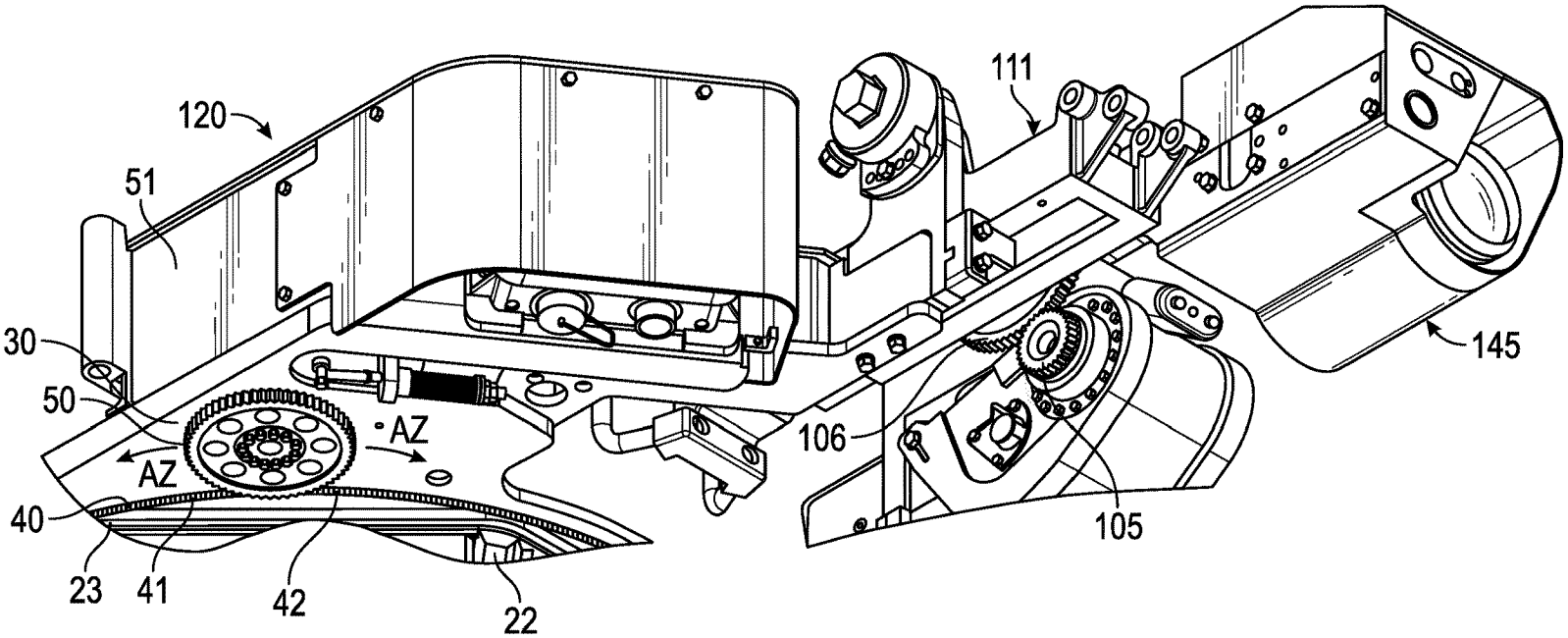
FIG. 11 is a schematic representation of an underside of an azimuth and elevation drive assemblies, which is part of the rotating platform.

The meshing of the azimuth output pinion 50 with the stationary azimuth ring gear 40 is best illustrated by FIG. 11. FIG. 11 shows the underside of azimuth assembly drive cover 51, which is part of the rotating platform 30. The azimuth output pinion 50 is external to azimuth assembly drive cover 51, while the remaining azimuth drive assembly components are protected by the azimuth assembly drive cover 51. For the rotating platform 30 to move in an azimuth direction, the azimuth output pinion 50 may be driven about the stationary azimuth ring gear 40 in azimuth directions, denoted AZ, either by electrically powered or manual means.

Referring again to FIG. 9, the SICWS 2 includes the SICWS rotating platform 30. The rotating platform 30 is rotatable about an azimuth axis, as shown in FIG. 9. The azimuth axis of rotation is normal to the roof of the turret 4. The rotating platform 30 includes the commander's weapon 9, side vision apertures 31, an azimuth drive assembly housing 120, ammunition supply 33, and a counter weight 32. If the commander is firing the commander's weapon 9 as shown in FIG. 8 and the commander is receiving hostile fire from either side of the SICWS 2, then the commander may crouch down and scan for the enemy laterally via side vision apertures 31, or from periscopes 22. Side vision apertures 31 provide further ballistic protection to the commander while offering lateral views when the commander is in an operator ingress and egress firing position, or in other words, an open-hatch firing position. Counter weight 32 helps balance the weight of the commander's weapon 9 and also provides the commander with further ballistic protection.

Referring again to FIG. 11, an illustration of how the stationary azimuth ring gear 40 fits between the low profile adapter 23 and the rotating platform 30 is shown. As described previously, the stationary azimuth ring gear 40 is mounted to the mounting surface 27 of the low profile adapter 23. The rotating platform 30 is then mounted on the stationary azimuth ring gear 40, which will hereafter be described in more detail.

Figure 12:
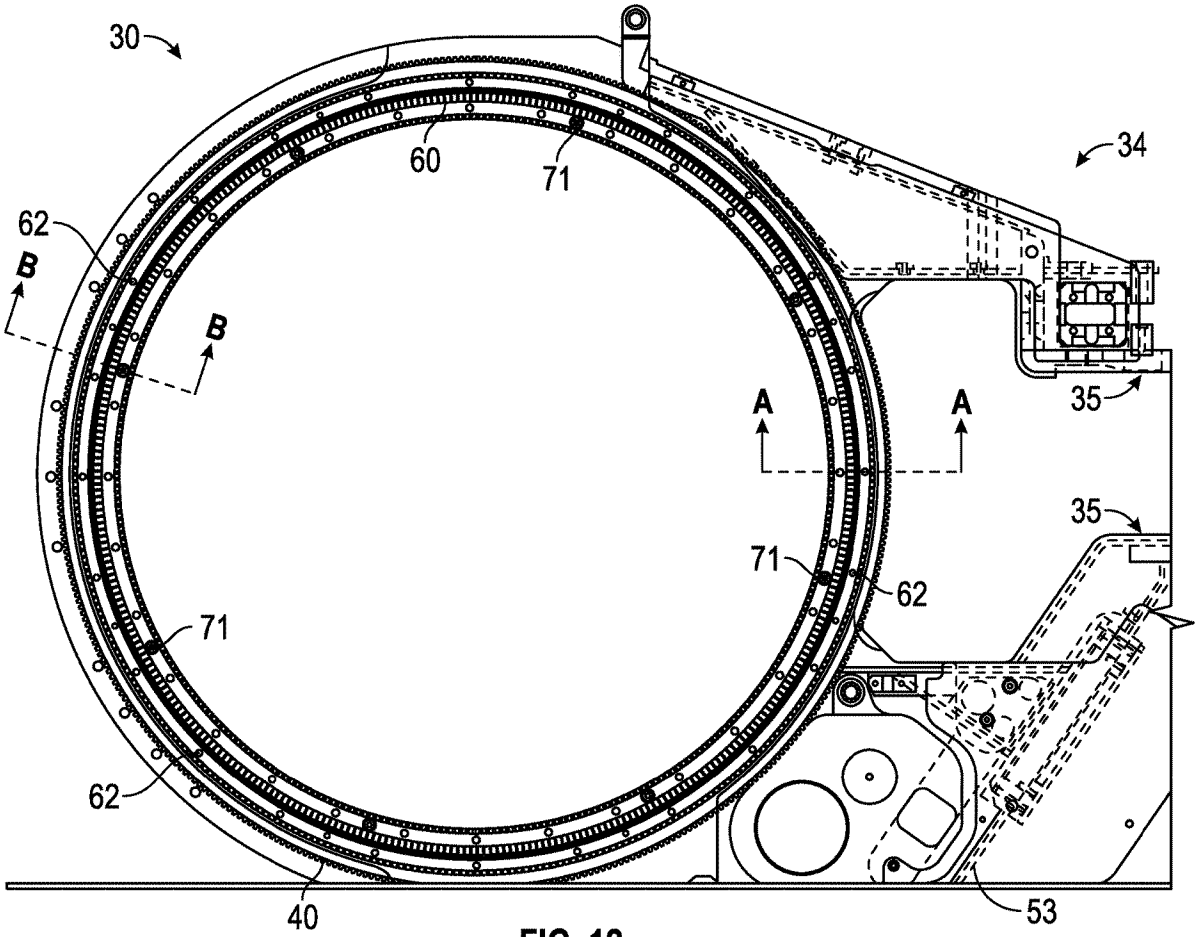
FIG. 12 is a top view of the rotating platform.

Referring now to FIG. 12, a top view of the rotating platform 30 is shown. The rotating platform 30 includes the azimuth drive section 53, the ammo box block 34, supporting structures for the weapon cradle 35, and the rotating assembly 60.

Figure 13A:
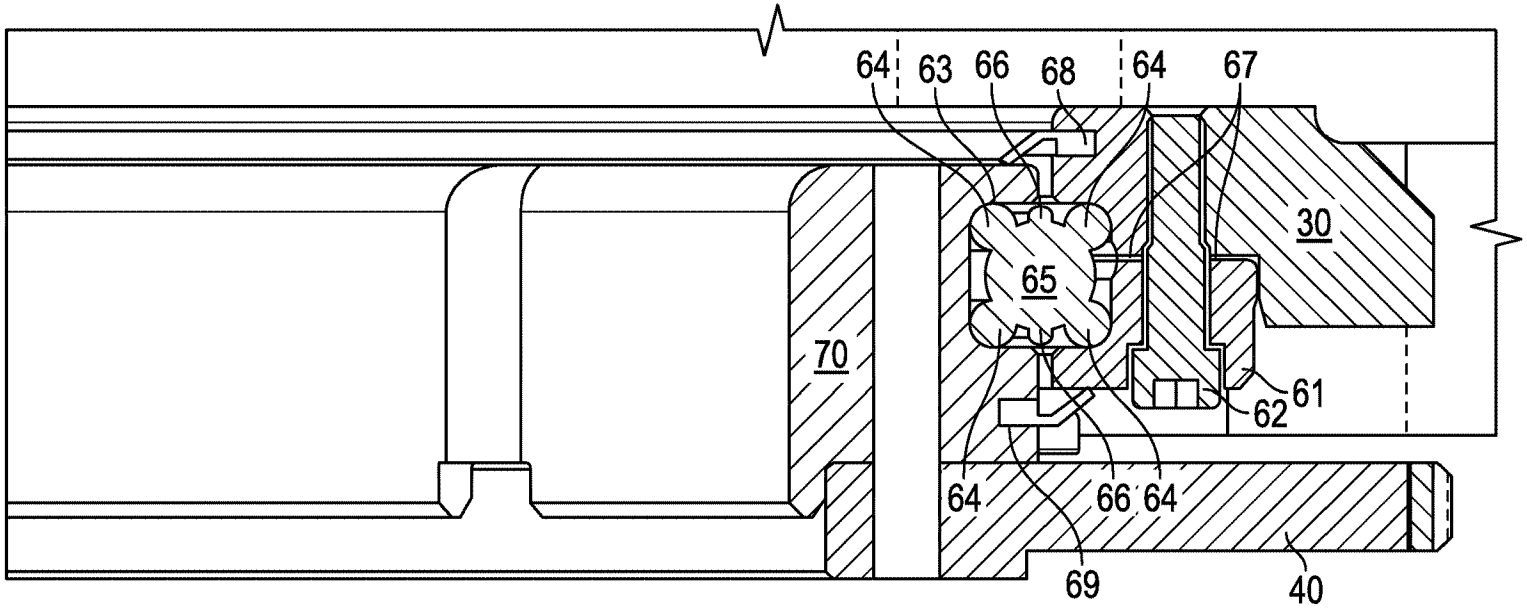
FIG. 13A, taken on line A-A of FIG. 12, shows a cross-sectional view of the components that comprise the rotating assembly.

FIG. 13A, taken along line A-A of FIG. 12, shows a cross-sectional view of the components that comprise the rotating assembly 60. The rotating platform 30 is attached to a lower retainer ring 61 via lower retainer ring cap screws 62. As can be seen in the top view of the rotating assembly 60 in FIG. 12, the rotating platform 30 is attached to the lower retainer ring 61 via multiple retainer ring cap screws 62 spaced apart around the circumference of the rotating platform 30. As shown in FIG. 13A, the lower retainer ring 61 and the rotating platform 30 attach to the outer perimeter of a wire race bearing 63. The lower retainer ring 61 and rotating platform 30 make up the rotating components of the rotating assembly 60.

The wire race bearing 63 includes four race rings 64, balls 65, and two ball cages 66. The wire race bearing 63 may be a Franke GmbH part number 68677A wire race bearing. Azimuth bearing shims 67 may be added or removed to compensate for the various internal tolerances and clearances of the bearing components. Upper bearing seal 68 and lower bearing seal 69 help maintain lubricants within the wire race bearing 63, while excluding contaminants. The exemplary wire race bearing 63 described herein facilitates azimuth rotation of the rotating platform 30, but one of ordinary skill in the art will appreciate that other types of bearings could be used to facilitate azimuth rotation of the rotating platform 30 as well. For example, the wire race bearing could use a combination of ball and roller bearings, or multiple rows of bearing elements, as well as various materials for the bearing rings, races, and rolling components.

Figure 13B:
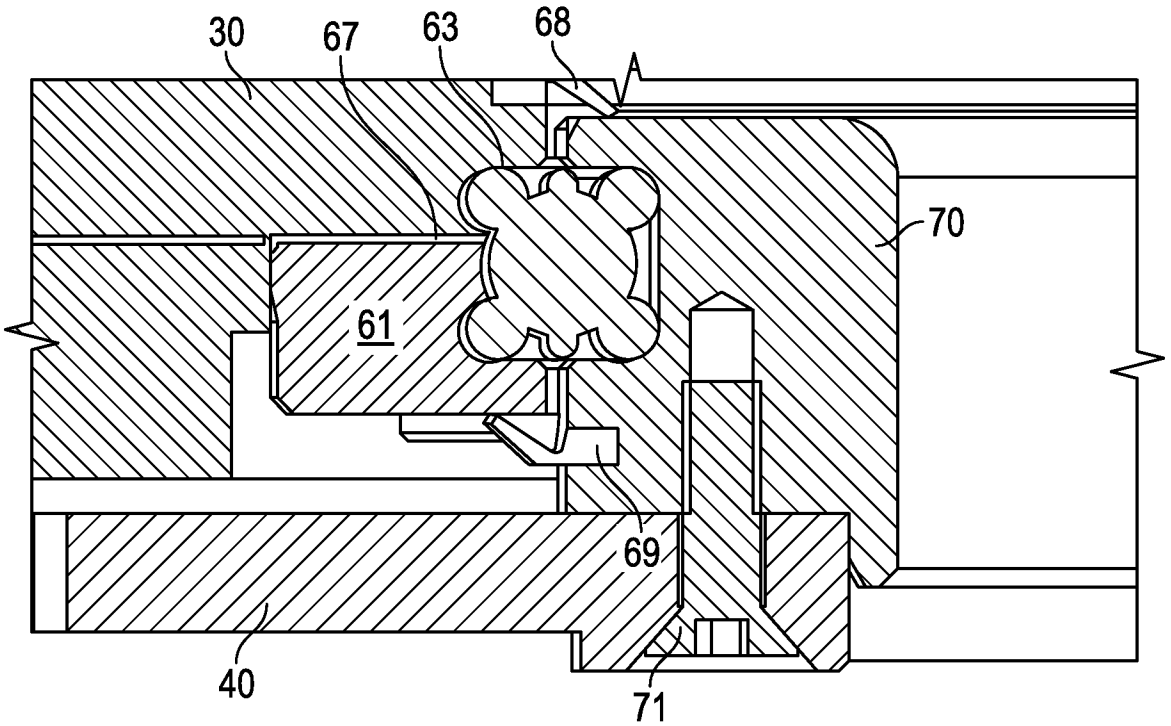
FIG. 13B, taken on line B-B of FIG. 12, shows a cross-sectional view of the components that comprise the rotating assembly.

FIG. 13B, taken along line B-B of FIG. 12, also shows a cross-sectional view of the components that comprise the rotating assembly 60. The stationary azimuth ring gear 40 is connected to an inner ring 70 via inner ring cap screws 71. As shown in the top view of FIG. 12, the inner ring cap screws 71 that attach the stationary azimuth ring gear 40 to the inner ring 70 are circumferentially spaced around the inner ring 70. As shown in FIG. 13B, the inner ring 70 and the stationary azimuth ring gear 40 attach to the inner perimeter of the wire race bearing 63. The inner ring 70 and the stationary azimuth ring gear 40 are fixed and do not rotate. The lower retainer ring 61 and the rotating platform 30 are driven about the non-rotating stationary azimuth ring gear 40 and the inner ring 70 by the azimuth output pinion 50.

As described earlier, the stationary azimuth ring gear 40 is mounted to the mounting surface 27 of the low profile adapter 23 and fixedly attached to the inner ring 70, which sits atop the stationary azimuth ring gear 40. When assembling the SICWS 2, it may be beneficial to attach the stationary azimuth ring gear 40 to the inner ring 70 first before mounting the stationary azimuth ring gear 40 to the mounting surface 27 of the low profile adapter 23.

Figure 14A:
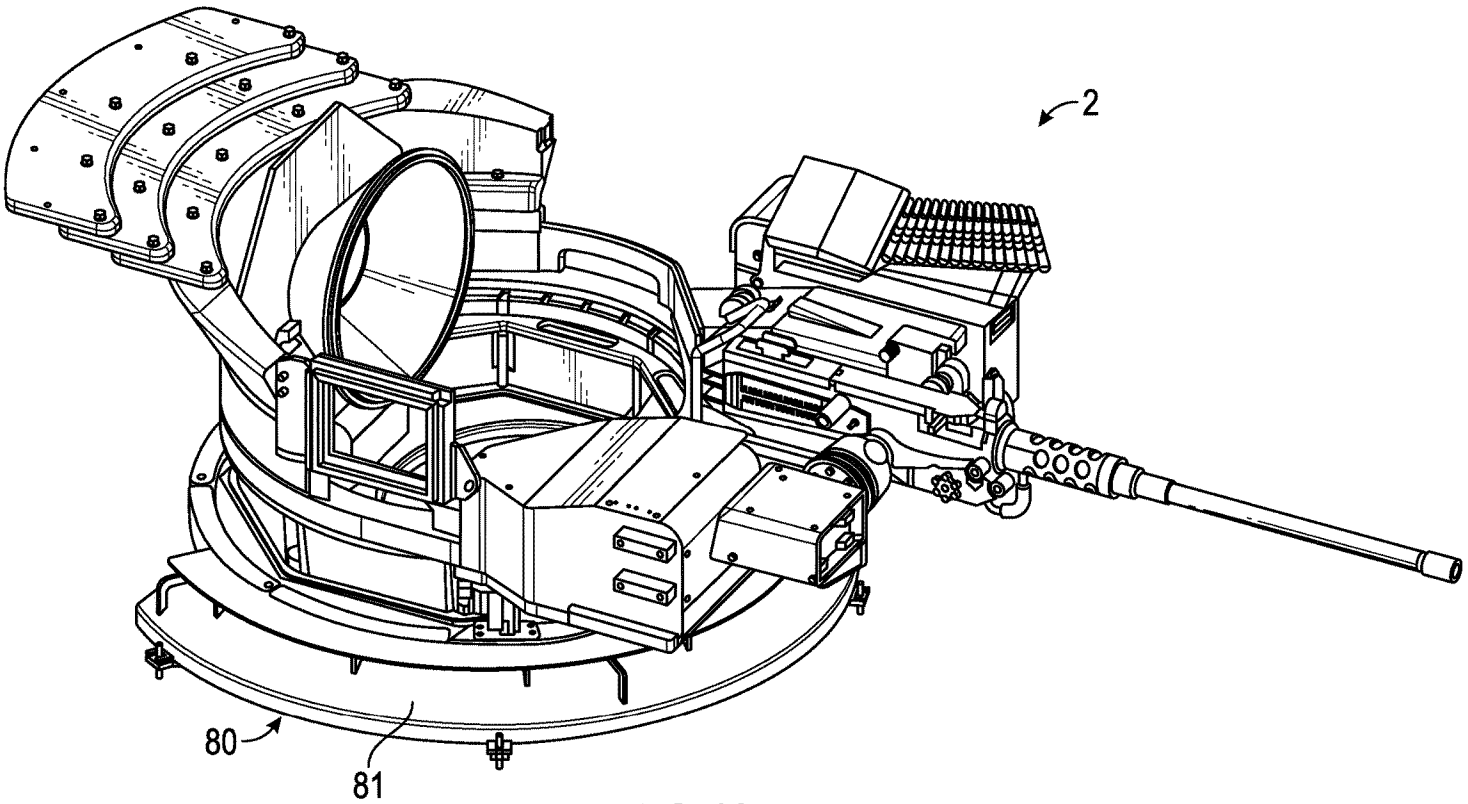
FIG. 14A is a perspective view of a cable management system with an armored ballistic shield.

Referring now to FIG. 14A, the SICWS 2 is shown fully assembled, and toward the base of the SICWS 2, a cable management system 80 is shown protected by an armored ballistic shield 81. Electrical power, control signals, and video signals are transferred between the vehicle structure of the turret 4 and the SICWS 2 through the novel cable management system 80. The cable management system 80 guides, protects and retains a group of electrical cables 82 with appropriate insulated connectors (not shown). The cable management system 80 is robust and insensitive to dirt or moisture contamination and permits azimuth rotation of nearly 360 degrees. This system eliminates the need for an electrical slip ring assembly, which tend to be costly, complex, sensitive to contamination by dirt, and unreliable.

Figure 14B:
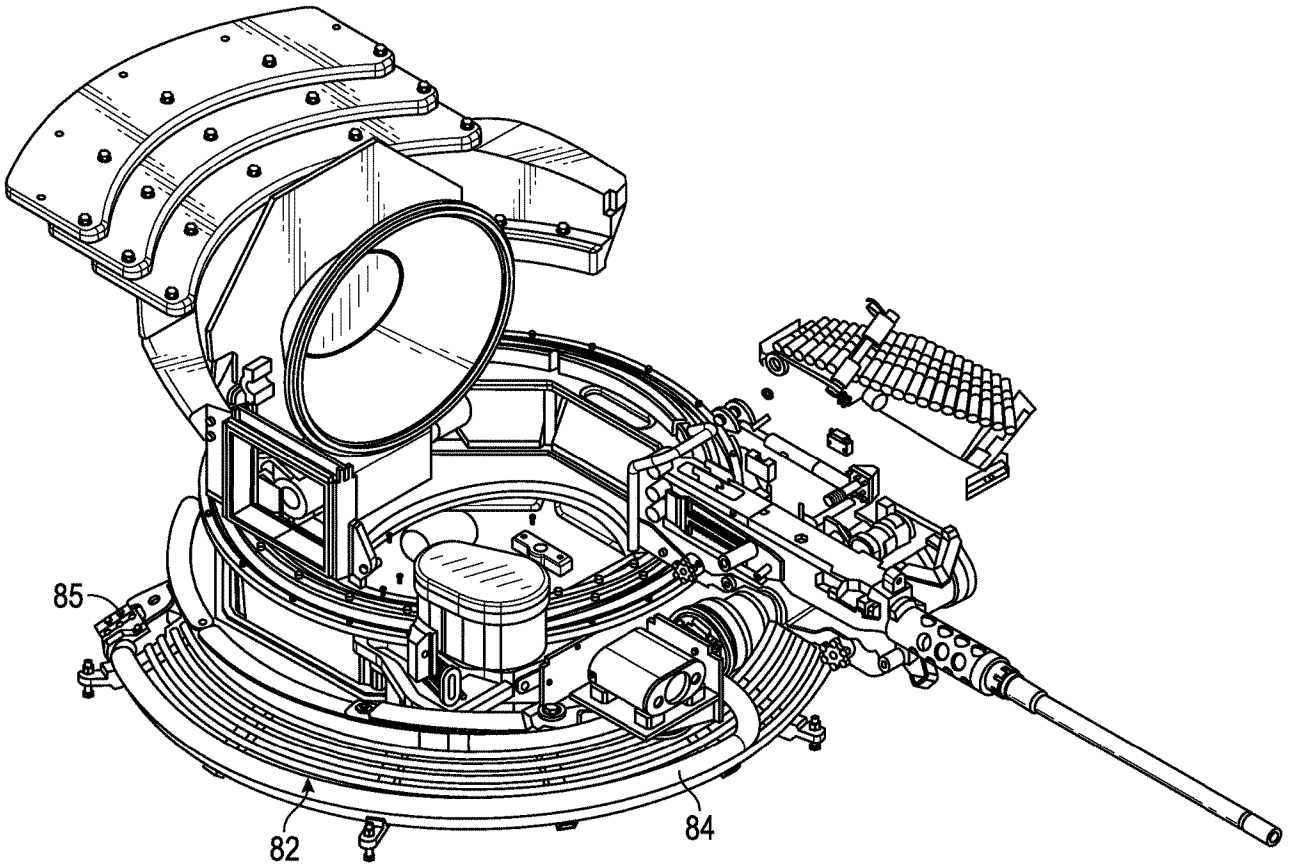
FIG. 14B is a perspective view of a cable management system of FIG. 14A with the armored ballistic shield removed.

The cable management system 80 is shown in FIG. 14B with the armored ballistic shield 81 removed for clarity. A conical grid 83 supports flexible cable conduit 84, yet the conical shape of the grid 83 is designed in such a way that it does not trap debris. The electrical cables 82 are protected by conduit 84, and enter the cable management system 80 through the turret cable entrance 85 and exit the cable management system 80 at the entrance of the SICWS rotating platform 30 through the rotating platform entrance 86.

Another embodiment of the SICWS 2 provides for an elevation mode select mechanism 90. The SICWS 2 may operate in one of three modes: stabilized, power, and manual. Stabilized mode is the most desirable of the three modes. In stabilized mode, elevation drive assembly 91 of the SICWS 2 is receiving power via elevation drive motor 107, and the commander's weapon 9 is isolated from the movement of the armored combat vehicle 1 by the action of gyroscopic sensors and control electronics thus improving the aiming and accuracy of the commander's weapon 9. Hence, the term "stabilized." In power mode, the commander's weapon 8 is not stabilized from the movement of the armored combat vehicle 1, but the elevation drive assembly 91 still receives power via the elevation drive motor 107. Thus, the commander's weapon 9 may be electrically powered to move up or down in an elevation direction. The SICWS 2 can move from stabilized mode to power mode if for example gyro instruments fail, signals fail to reach the SICWS 2, or if a processor controlling the armored combat vehicle's 1 stabilization functions fails. In manual mode, the SICWS 2 has lost power and thus the commander's weapon 9 can no longer be moved in an elevation direction by electrically powered means. Hence, in the event of power loss, the commander's weapon 9 must be aimed by manual means. The elevation mode select mechanism 90 allows the commander's weapon 9 to be operated in either a manual or stabilized/power modes.

Figure 15:
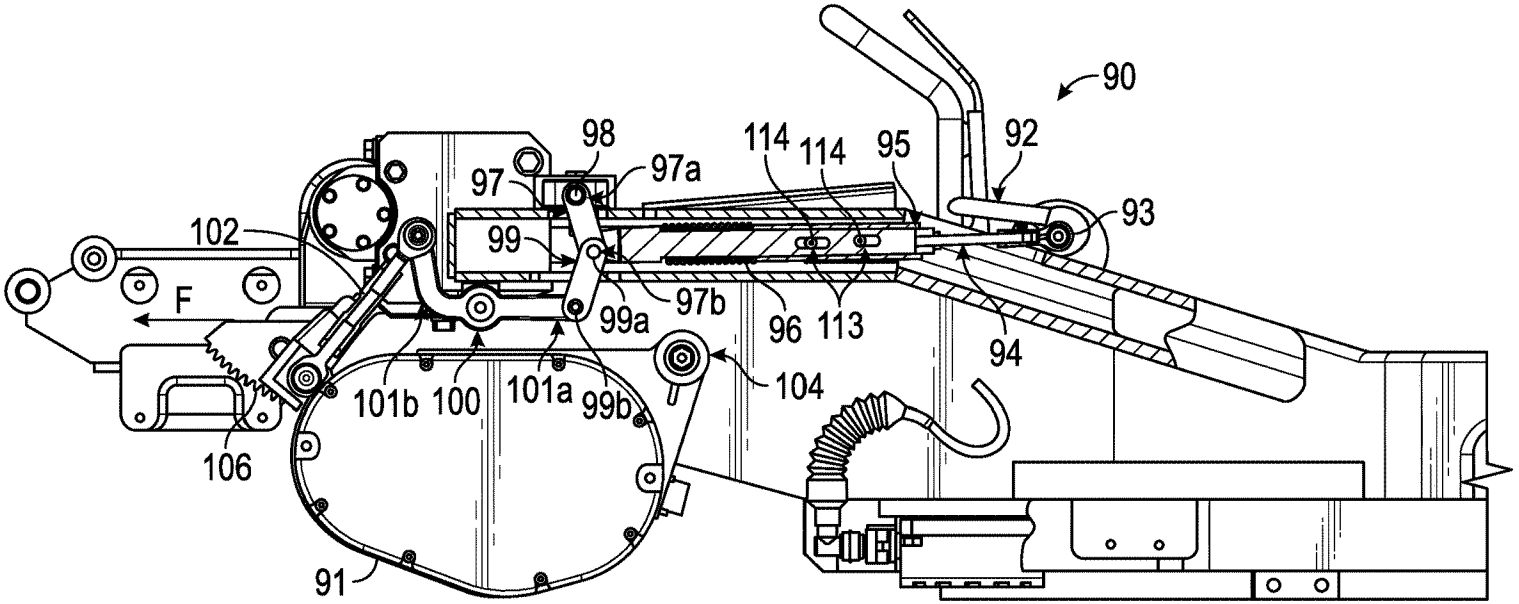
FIG. 15 is a side view of a mode select mechanism in power/stabilized mode.

Referring now to FIG. 15, the mode select mechanism 90 is shown comprising mode select input 92, which operates to ultimately engage or disengage the elevation drive assembly 91. Mode select input 92 could be a handle or lever, as shown in FIG. 15. Alternatively, mode select input 92 could be any number of input devices, including but not limited to a switch electrically connected to a mechanical means, such as a lever, where power is provided by an auxiliary power unit.

In this example, mode select input 92 is a lever, and when it is pushed all the way forward, meaning in the same direction as the forward direction arrow F, the selected mode is in the stabilized/power mode. If all of the armored combat vehicle's 1 systems are functioning properly, the mode of operation will be the stabilized mode. If the commander's weapon 9 is no longer isolated from the movement of the rest of the vehicle, the mode of operation will be power mode. If the mode select input 92 is pulled all the way back opposite the forward direction arrow F, then the mode selected is manual mode. Thus, the commander may select either the stabilized/power mode or manual mode via the mode select input 92.

FIG. 15 shows the elevation mode select input 92 in the stabilized/power mode position. The mode select input 92 is attached to an eccentric 93, which has an eccentric arm 94 that extends and attaches to a telescopic sleeve 95. The telescopic sleeve 95 encloses a preloaded spring 96 to protect it from debris. The telescopic sleeve 95 is connected to an upper toggle link 97 and a lower toggle link 99. The bottom portion 97*b* of the upper toggle link 97 is hingedly connected to the telescopic sleeve 95 and the upper portion 97*a* of the upper toggle link 97 is hingedly fastened to upper toggle link pivot point 98. The upper portion 99*a* of lower toggle link 99 is hingedly connected to the telescopic sleeve 95 and the bottom portion of lower toggle link 99*b* is hingedly connected to first fulcrum arm 101*a*. First fulcrum arm 101*a* attaches to a fulcrum 100, which has a second fulcrum arm 101*b* extending opposite of the first fulcrum arm 101*a*. Second fulcrum arm 101*b* attaches to tie rod 102, which ties the elevation drive assembly 91 with the mechanical workings of the mode select mechanism 90.

Figure 16:
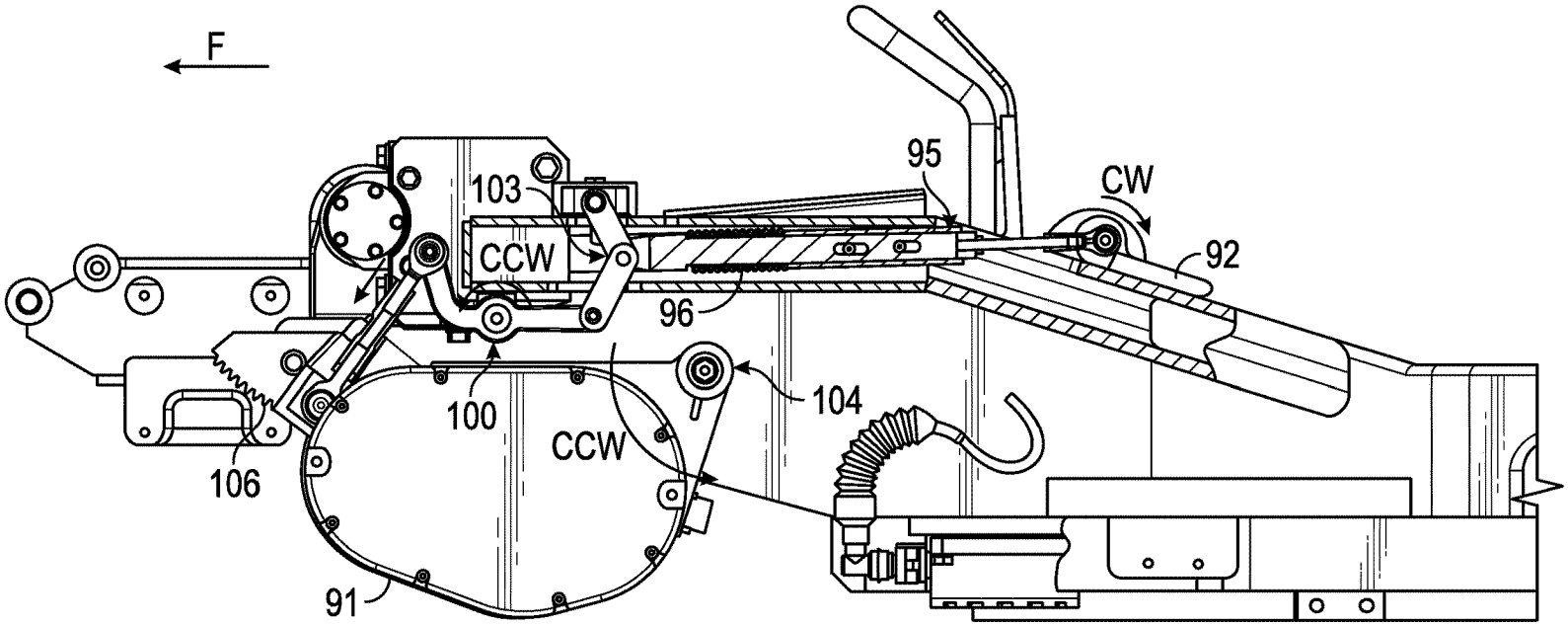
FIG. 16 is a side view of a mode select mechanism in manual mode.

Referring now to FIG. 16, operation of the commander's weapon 9 in manual mode requires decoupling of the elevation drive assembly 91. Decoupling is readily achieved by the commander pulling the mode select input 92 toward him or herself (opposite forward facing direction F) with low effort to the manual mode position. As the mode select input 92 is pulled back into manual mode, the eccentric 93 rotates in a clockwise direction CW, causing the eccentric arm 94 and telescopic sleeve 95 to translate in a direction opposite forward facing direction F. As this occurs, the preloaded spring 96 is elongated (or decompressed) toward its natural equilibrium state. However, the preloaded spring 96 is never allowed to reach equilibrium, it is maintained in a compressed state even in manual mode.

Figure 34:
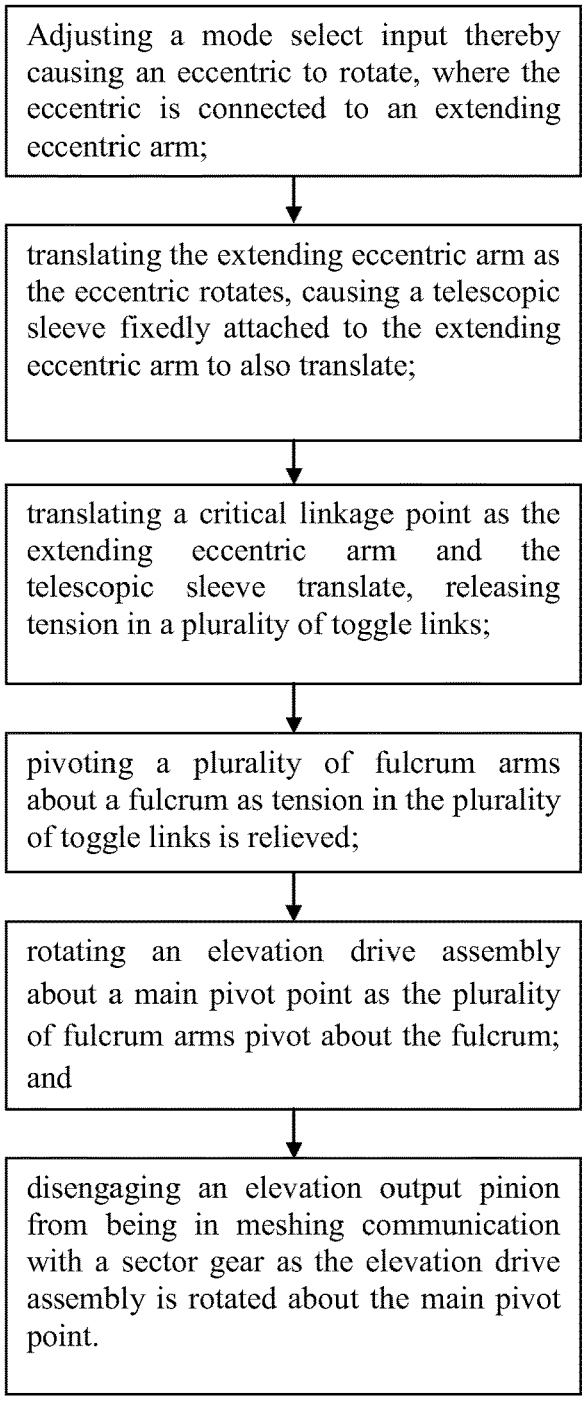
FIG. 34 is a flow chart illustrating a method to disengage an elevation drive assembly from a stabilized/power mode to a manual mode.

As the preloaded spring 96 elongates and the telescopic sleeve 95 translates opposite forward facing direction F, the critical linkage point 103, the linkage between the upper toggle link 97, the lower toggle link 99, and the telescopic sleeve 95, is pulled or translated in a direction opposite forward facing direction F. The translation of the critical linkage point 103 causes the fulcrum arms 101 (first fulcrum arm 101*a* and second fulcrum arm 101*b*) to rotate about the fulcrum 100 in a counterclockwise direction CCW, as shown in FIG. 16. As the fulcrum arms 101 rotate about the pivot point of fulcrum 100, the connection point between the second fulcrum arm 101*b* and tie rod 102 drops slightly in elevation and slightly in a forward facing direction F. As this occurs, the elevation drive assembly 91 rotates about a main pivot point 104 in a counterclockwise direction CCW, causing elevation output pinion 105 to no longer be in contact with sector gear 106. FIG. 34 illustrates a method to disengage the exemplary elevation drive assembly 91 from a stabilized/power mode to a manual mode as shown in FIG. 16. The relationship between the elevation output pinion 105 and the sector gear 106 will be described hereafter in more detail.

Figure 17:
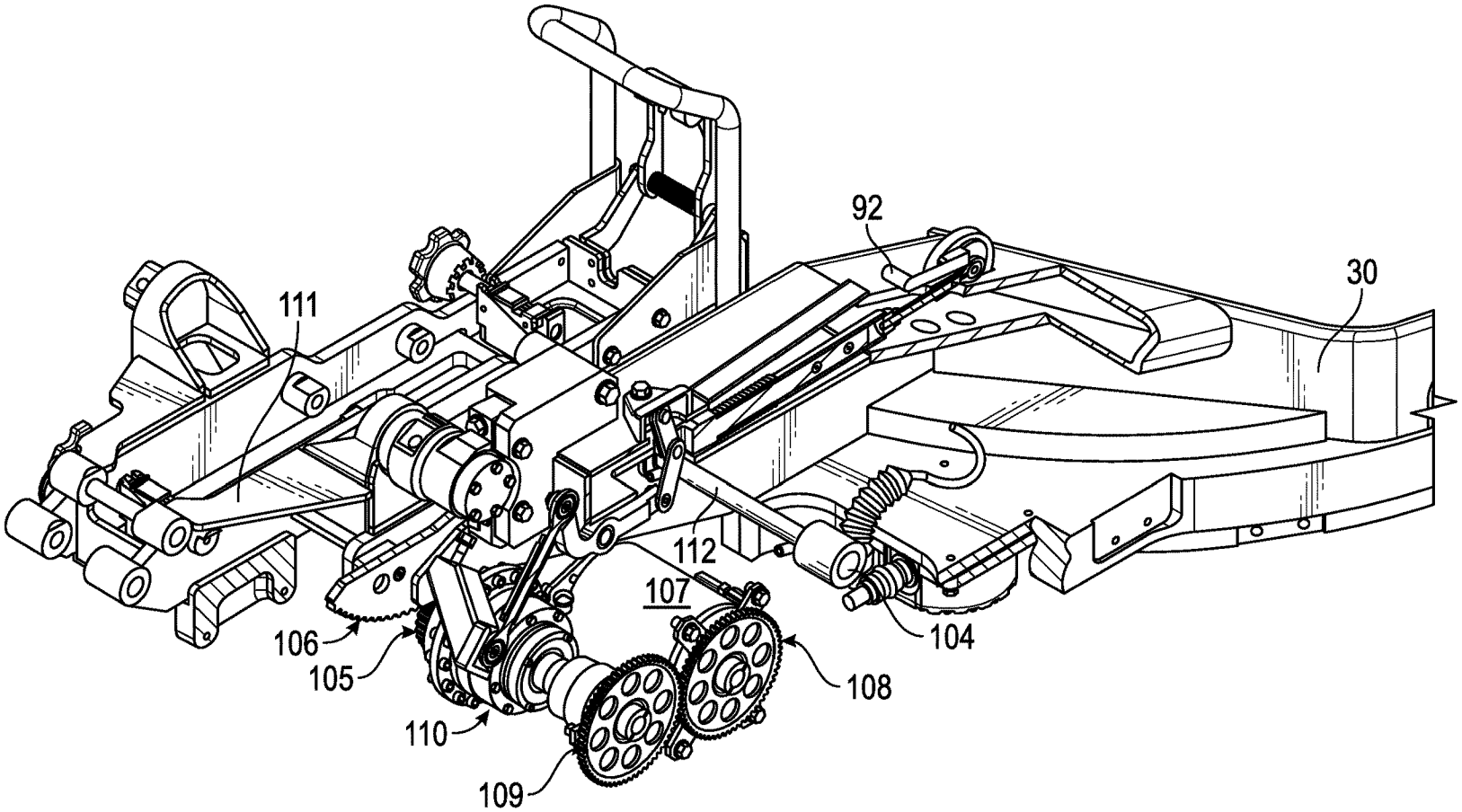
FIG. 17 is a perspective view of an elevation drive assembly with an elevation drive housing removed for clarity.
Figure 18:
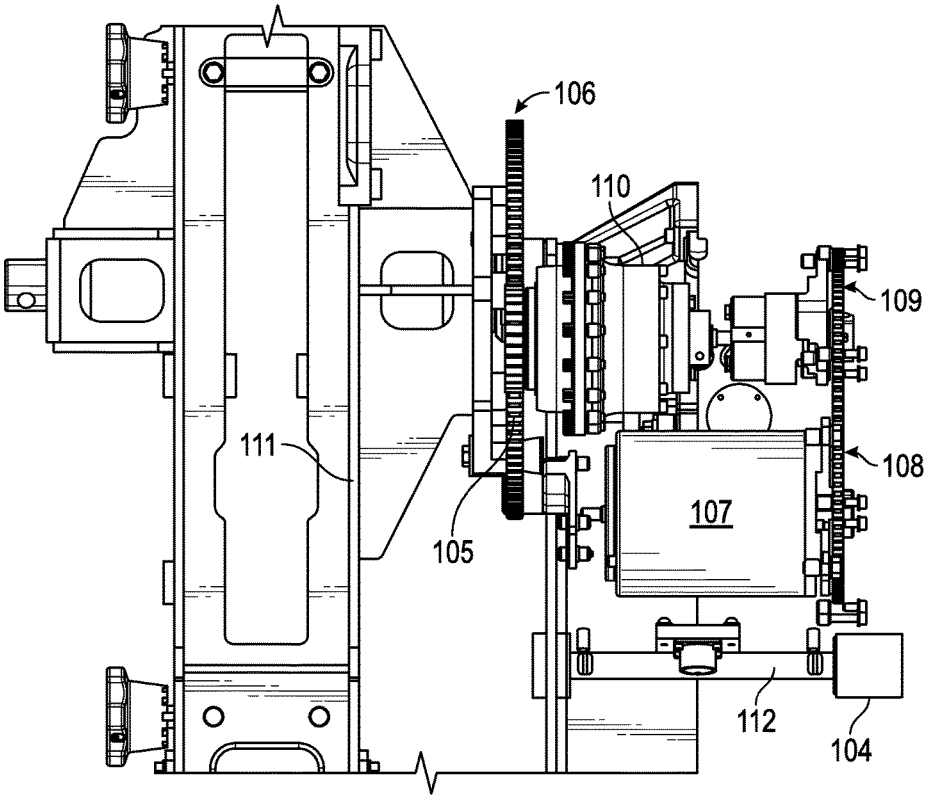
FIG. 18 is a bottom view of an elevation drive assembly illustrating the elevation output pinions location in relation to a sector gear.

Referring now to FIGS. 17 and 18. FIG. 17 is a perspective view of the elevation drive assembly 91 with the elevation drive housing removed for clarity. FIG. 18 is a bottom view of the elevation drive assembly with the elevation drive housing removed for clarity. The elevation drive assembly 91 includes an elevation drive motor 107, which is the electrical power source of the elevation drive assembly 91. The elevation motor 107 drives a shaft which in turn rotates translation gear 108. Translation gear 108 meshes and transmits power to an adjacent second translation gear 109, which rotates a shaft that in turn rotates a set of planetary gears enclosed within planetary gear box 110. The output of the planetary gear box 110 is transmitted to the elevation output pinion 105 via a shaft. The elevation output pinion 105, when meshed with the sector gear 106, moves about the sector gear 106 to change the elevation of the commander's weapon 9. The sector gear 106 is stationary, meaning it is fixedly mounted to the side of the weapon cradle 111. FIG. 18 illustrates how the elevation output pinion 105 lines up with the sector gear 106. FIGS. 17 and 18 show main elevation assembly pin 112, which allows the elevation drive assembly 91 to rotate about the elevation drive assembly's main pivot point 104.

Figure 20:
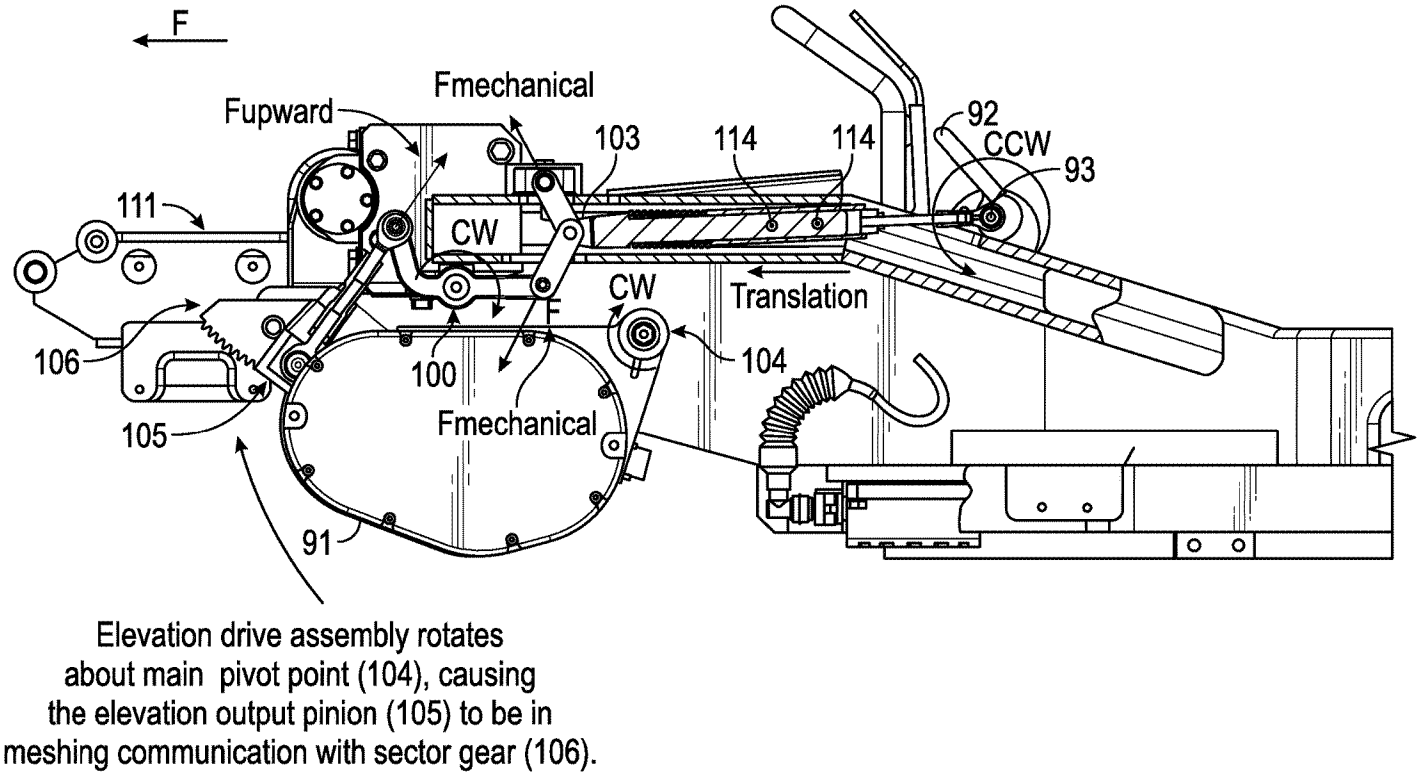
FIG. 20 is a side view of a mode select mechanism switching between manual and power/stabilized mode.
Figure 35:
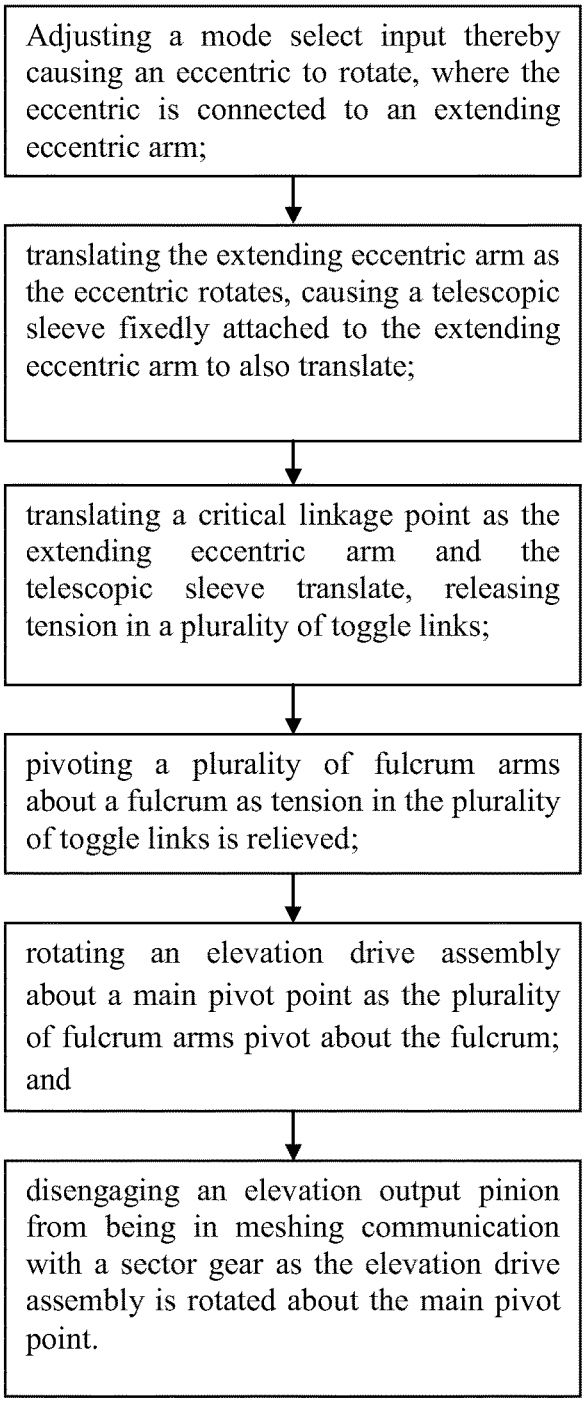
FIG. 35 is a flow chart illustrating a method to engage an elevation drive assembly from a manual mode to a stabilized/power mode.

If the commander is operating the commander's weapon 9 in manual mode and desires to operate in power or stabilized mode (assuming all systems are working), then the commander must push the mode select input 92 into the forward F position, as shown in FIG. 20. As this occurs, the eccentric 93 rotates in a counterclockwise CCW direction, translating the eccentric arm 94 and telescopic sleeve 95 in a forward direction F. As this translation occurs, the preloaded spring 96 is compressed. The ultimate effect of the mode select input 92 moving into a forward position F is that the upper toggle link 97 and the lower toggle link 99 are forced into a vertical position, causing the fulcrum arms 101 to rotate in a clockwise position about the fulcrum's 100 pivot point. This, in turn, causes the linkage between the second fulcrum arm 101*b* and the tie rod 102 to move slightly upward and slightly back, or opposite forward facing direction F. As a result, the tie rod 102, in tension, causes the elevation drive assembly 91 to pivot in a clockwise direction about the main pivot point 104. As a result, the elevation drive assembly 91 is lifted upward, allowing the gear teeth of the elevation output pinion 105 to mesh with the gear teeth of the sector gear 106. FIG. 35 illustrates a method to engage the exemplary elevation drive assembly 91 from a manual mode to a stabilized/power mode as shown in FIG. 20.

Figure 19:
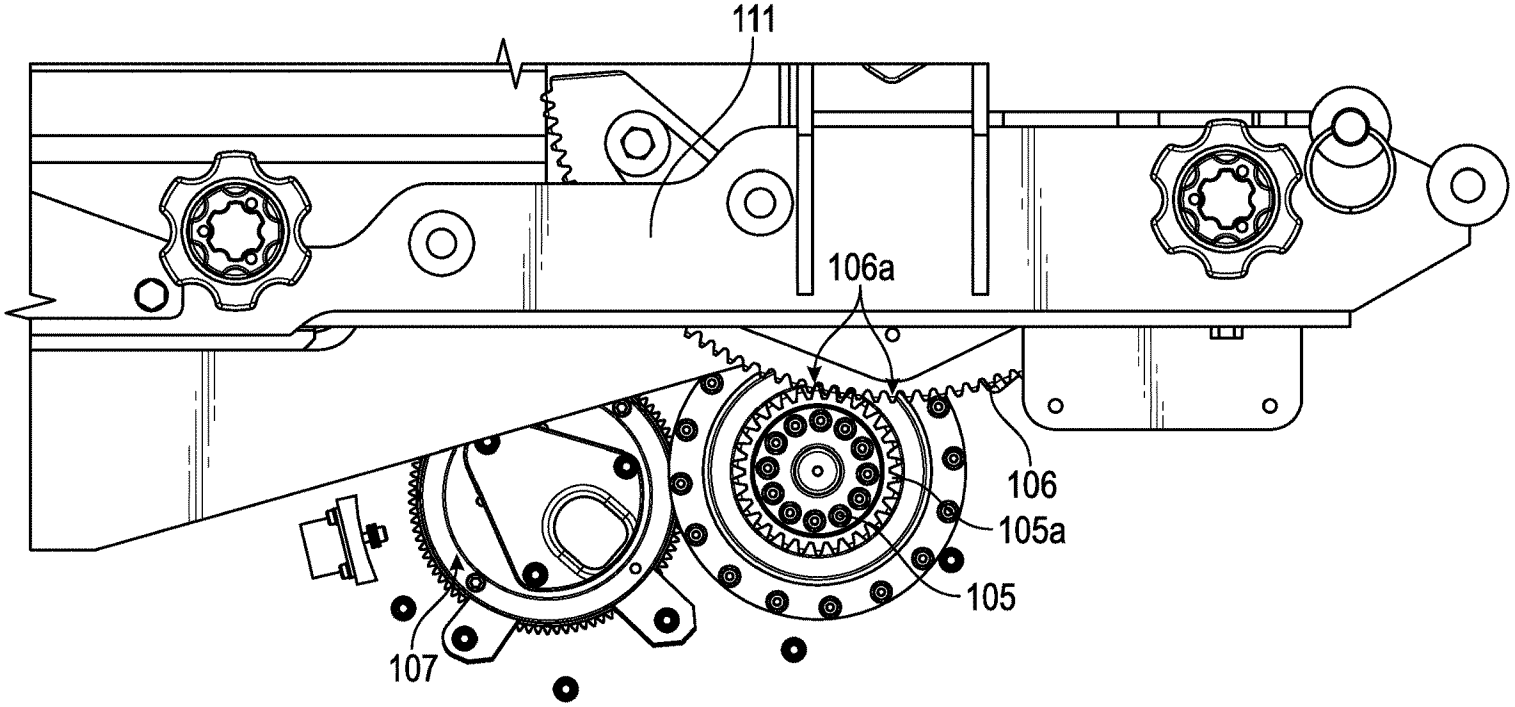
FIG. 19 is a side view of an elevation output pinion meshing with a sector gear.

FIG. 19 illustrates meshing of the elevation output pinion 105 and sector gear 106. In power and stabilized mode, the mode select mechanism 90 applies a high magnitude linear force via the compressed preloaded spring 96 and mechanical linkages to maintain zero backlash engagement of the weapon sector gear 106 between the elevation drive assembly 91 and the weapon cradle 111.

Actuation of the mode select input 92 from a manual mode position to a power/stabilized mode position (or vice versa) requires approximately 15 $lb_f$ (pound force) of force application by the commander. The input force required to move the mode select input 92 (to ultimately change modes) was designed to be as minimal as possible, and thus the orientation of the mechanical linkages were designed to maximize the mechanical advantage, or the ratio of the output force to the input force ($F_{output}/F_{input}$). When the upper toggle link 97 and lower toggle link 99 are pushed by the telescopic sleeve 95 into an almost vertical position, the output force $F_{output}$ is transmitted and magnified to the upper portion 97*a* of upper toggle link 97 and to the lower portion 99*b* of the lower toggle link 99. The output force exerted on lower portion 99*b* of the lower toggle link 99 causes the fulcrum arms 101 to rotate in a clockwise direction CW. Because a very low input force $F_{input}$ is required to move upper toggle link 97 and lower toggle link 99 into an almost vertical position and the output forces are relatively high, the elevation mode select mechanism 90 achieves a significant mechanical advantage.

Referring now to FIGS. 15, 19, and 20, it is foreseeable that when the commander is switching from manual to power/stabilized mode that gear teeth 105*a* of the elevation output pinion 105 may not align correctly with the gear teeth 106*a* of the sector gear 106, creating a tooth tip-to-tooth tip contact. To account for this tooth tip-to-tooth tip condition, the telescopic sleeve 95 includes two slots 113. The two slots 113 permit two pins 114 to translate within the slots 113 in order to provide further compression of the preloaded spring 96 and full motion of the mode select input 92. Upon application of powered rotation, the elevation output pinion 105 will rotate until correct alignment with sector gear 106 achieved, at which time full tooth engagement, or meshing, will occur.

Another embodiment of the SICWS 2 includes an azimuth drive assembly 120 comprising an integrated crank mounted manual input device 121 to permit accurate azimuth positioning in manual mode, i.e., the absence of electrical power. The rotating platform 30 can prove difficult to move in an azimuth direction because of its forward weight bias. Thus, it is desirable to create a manual input device 121 that provides the commander (or operator) with a mechanical advantage to more easily rotate the rotating platform 30 in an azimuth direction, especially when the vehicle is in an inclined attitude.

Figure 21:
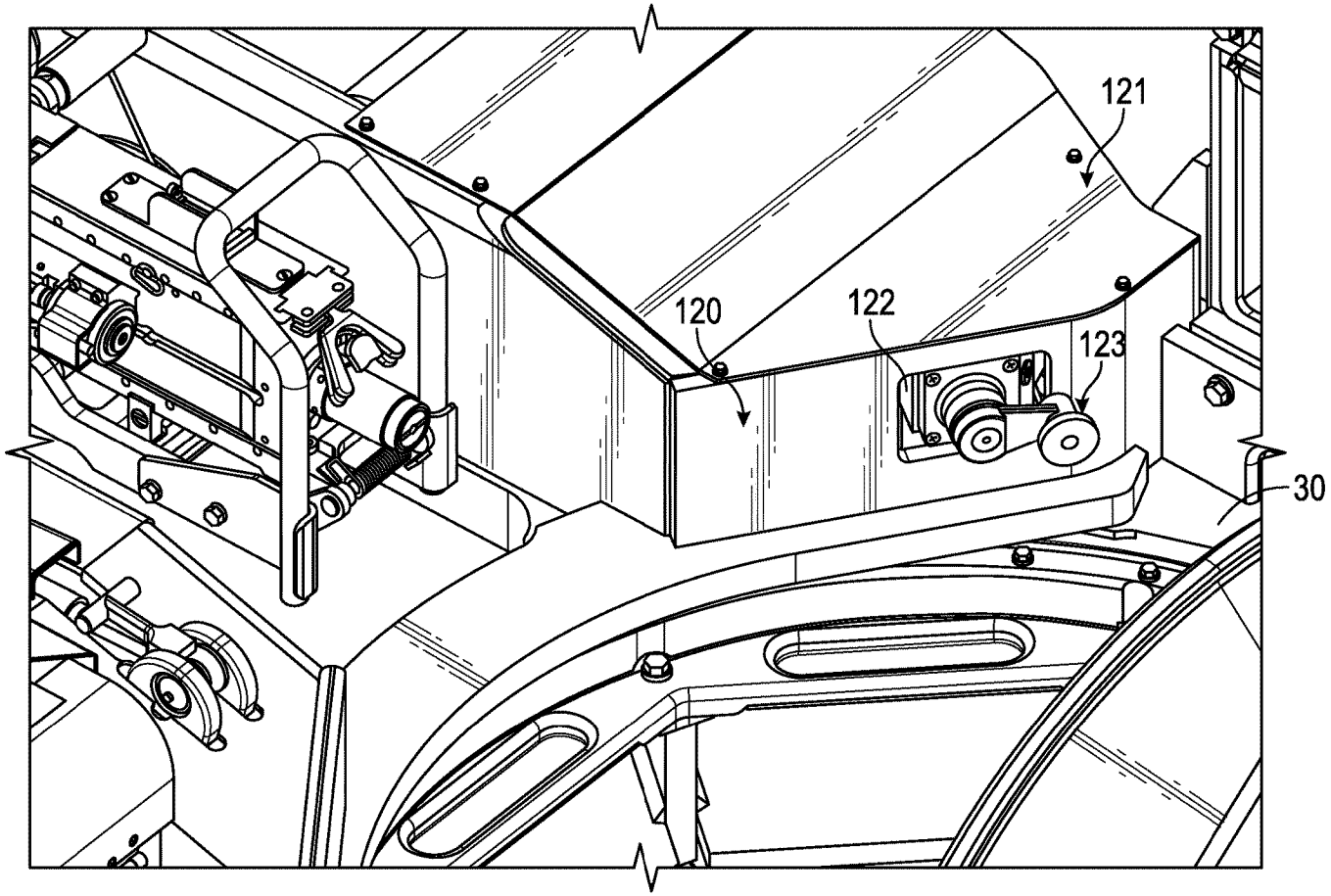
FIG. 21 illustrates the location of a manual input device.

The location of the manual input device 121 is shown in FIG. 21. The manual input device 121 may be mounted on a side portion of the azimuth drive assembly housing 122. The manual input device 121 includes a crank handle 123. The crank handle 123 may be rotated in a clockwise or counterclockwise direction, depending on the desired azimuth direction the commander wishes to rotate the rotating platform 30.

Figure 22:
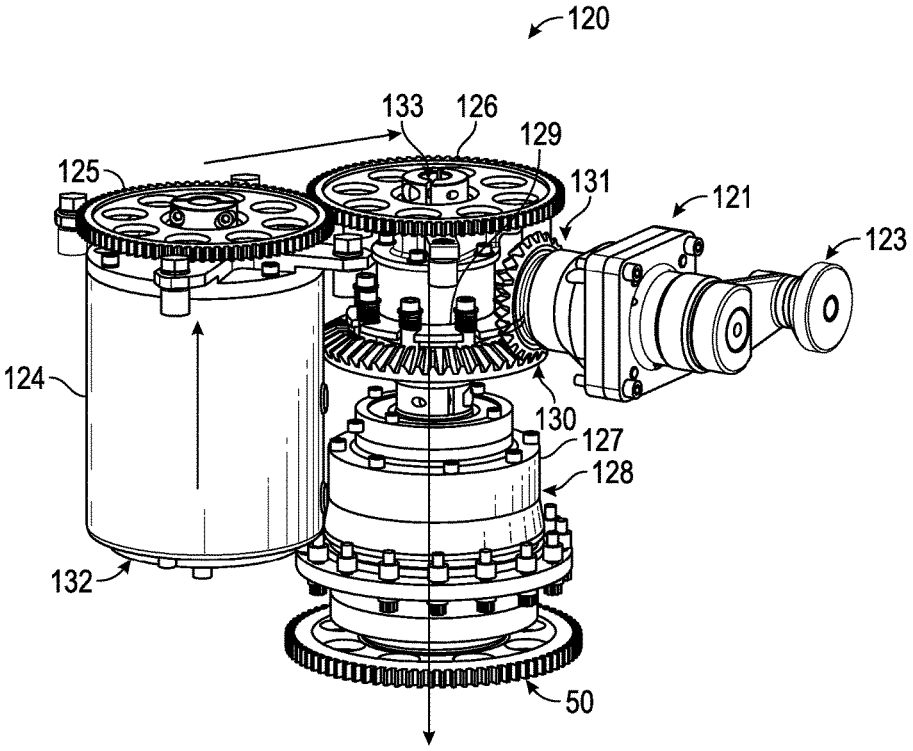
FIG. 22 illustrates the flow of power through an azimuth drive assembly in power/stabilized mode.

First, the power flow of the azimuth drive assembly 120 as it operates in power/stabilized mode will be described. FIG. 22 illustrates the flow of power through the azimuth drive assembly in power/stabilized mode. Mechanical power is generated by the azimuth drive motor 124. The power produced by the azimuth drive motor 124 is then transmitted to a shaft which in turn drives a First transfer gear 125. First transfer gear 125 meshes with and transfer power to second transfer gear 126. Second transfer gear 126 is attached to main shaft 133, which drives reduction gears 127 (not shown) enclosed within a reduction unit 128 to lower the output speed and increase torque of the azimuth output pinion 50. After reduction, the reduction gears transmit power to the azimuth output pinion 50, which as described earlier, moves about the stationary azimuth ring gear 40 to rotate the rotating platform 30. The flow of power in the azimuth drive assembly 120 as it operates in power/stabilized mode can be seen by the arrows in FIG. 22.

While the azimuth drive is in power/stabilized mode, the manual input device 121 is inactive. To prevent inadvertent azimuth movement, a series of electromagnetic brakes 129 are energized to disengage main bevel gear 130 from main shaft 133. This ensures accurate azimuth movement when operating in power/stabilized mode, and prevents application of powered rotation to crank handle 123.

Figure 23:
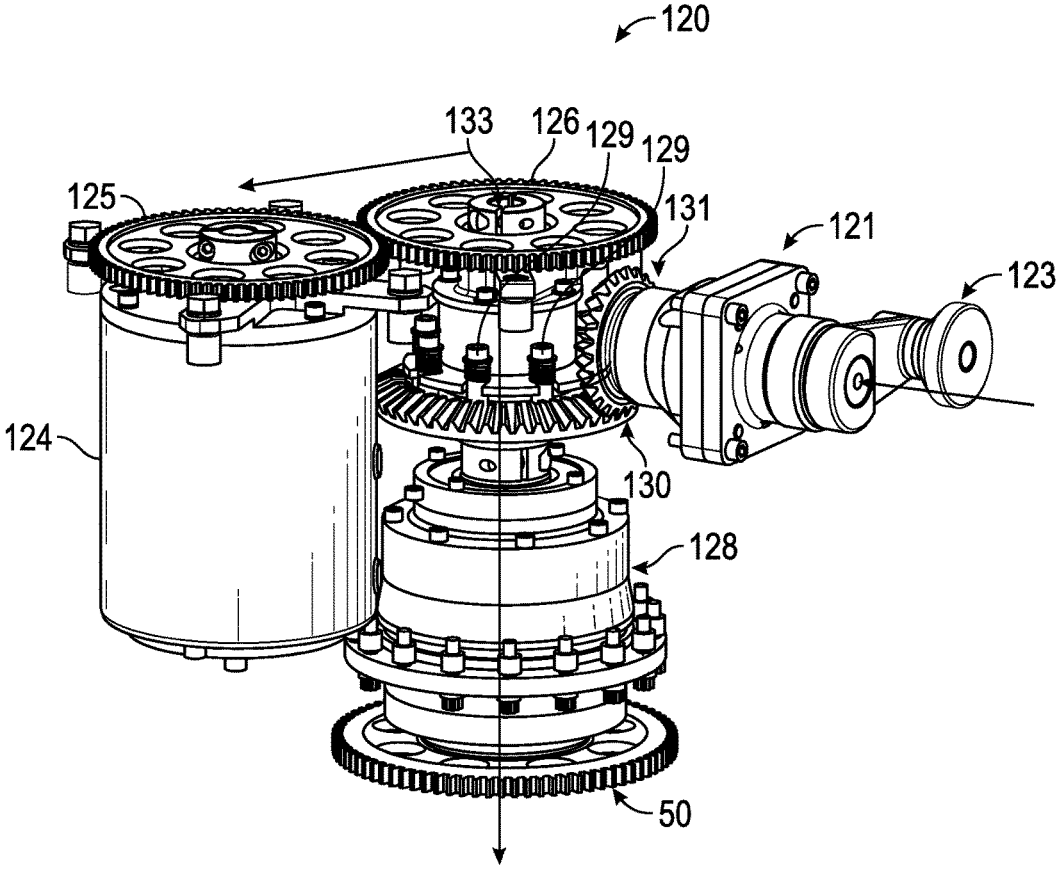
FIG. 23 illustrates the flow of power through an azimuth drive assembly in manual mode.

Second, the power flow of the azimuth drive assembly 120 as it operates in manual mode will be described. FIG. 23 illustrates how the manual input device 121 drives the azimuth output pinion 50 in manual mode. The flow of power through the azimuth drive assembly 120 as it operates in manual mode can be seen by the arrows in FIG. 23 and will hereafter be described in more detail.

In this example, the crank handle 123 comprises a lock plunger 123*a* that engages the azimuth assembly drive housing 122. By operator retraction of the lock plunger 123*a*, the crank handle 123 may be rotated clockwise CW or counterclockwise CCW, depending on the desired azimuth direction. When the crank handle 123 is rotated, a shaft that is connected to the crank handle 123 rotates drive bevel gear 131. Drive bevel gear 131, when driven via the crank handle 123, transmits power to main bevel gear 130. In this example, main bevel gear 130 includes straight, conically pitched gear teeth. One of ordinary skill in the art will appreciate that many types of gears could be used in this situation.

The electromagnetic brakes 129 are de-energized in manual mode, allowing the main bevel gear 130 to rotate when power is transmitted to it via the drive bevel gear 131. The main bevel gear 130 rotates main shaft 133 when driven by drive bevel gear 131. Main shaft 133 transmits power to the reduction gears 127 (not shown) enclosed within reduction unit 128 in much the same way as when the azimuth drive assembly 120 is operated in power mode. After reduction, the reduction gears transmit power to the azimuth output pinion 50.

The main shaft 133 is also connected to second transfer gear 126, which is in meshing contact with first transfer gear 125. First transfer gear 125 is attached to a shaft driven by azimuth drive motor 124 in power mode. When in manual mode, the azimuth drive motor 124 does not contain a brake; it freewheels when hand crank handle 123 is rotated manually.

Next, a sight alignment system 140 for optical sighting unit 145 will be described. The optical sighting unit 145 provides the optical sight for the commander's weapon 9. The commander may operate the commander's weapon 9 from within the turret compartment using the optical sighting unit 145 to aim at enemy targets. A very high accuracy of alignment between the optical sighting unit 145 and commander's weapon 9 must be readily achievable and maintained to assure high hit probabilities and firing accuracy. To accomplish these goals, the sight alignment system 140 comprising an azimuth adjustment assembly 150 and elevation adjustment assembly 190 permits fine tuning adjustment capabilities, including sight-to-weapon alignment in azimuth and elevation planes. Once adjusted, both the azimuth adjustment assembly 150 and elevation adjustment assembly 190 may be rigidly locked in the desired position. Generally, the desired position is to align the crosshairs of the optical sighting unit 145 with the location of where the barrel of the commander's weapon 9 is aimed at a given distance, i.e., the crosshairs must be aligned with a given target. Fine tuning of the optical sighing unit 145 is necessary for firing accuracy of the commander's weapon 9 due to variations in trajectory of ammunition, possible misalignment of the optical sighting unit 145 in prior missions, and many other factors that could create sight-to-weapon misalignment of the optical sighting unit 145 and the commander's weapon 9. The novel features of the sight alignment system 140 will hereafter be described.

Figure 24:
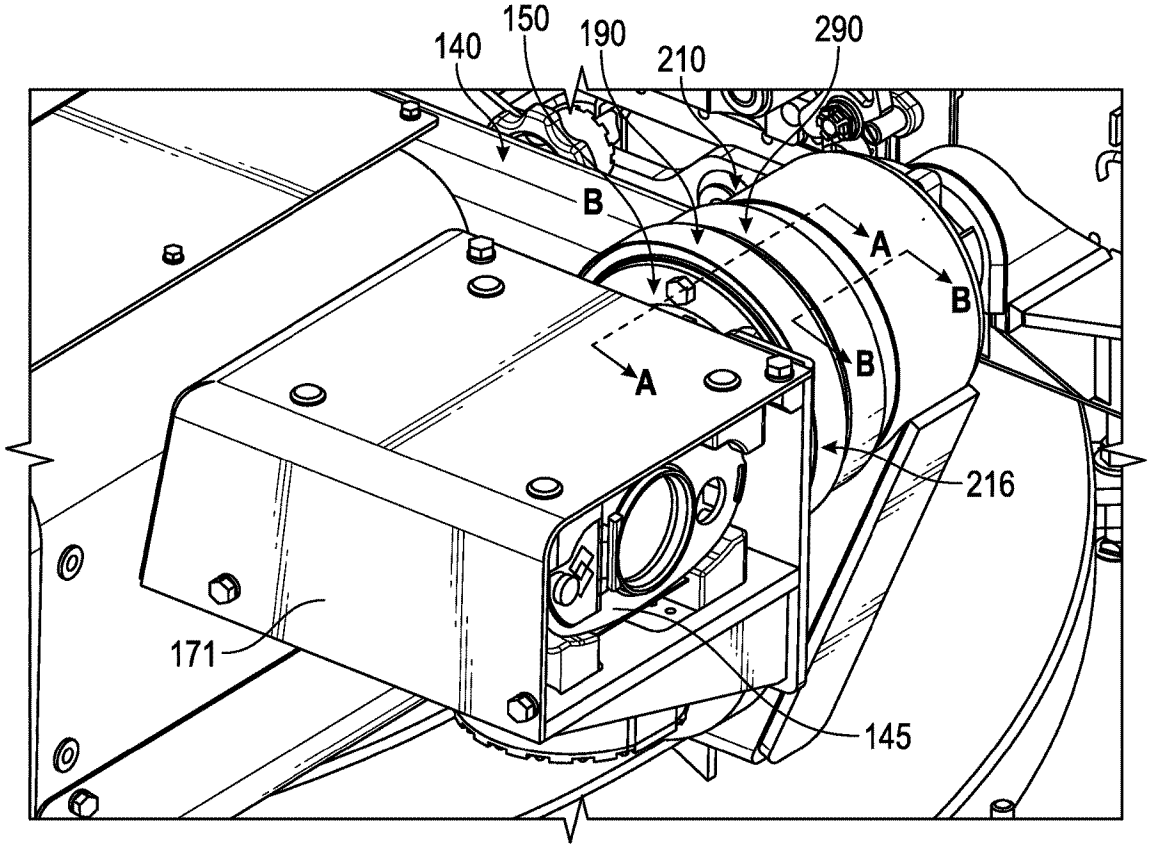
FIG. 24 is a perspective view of a sight alignment assembly of one embodiment of the SICWS.

Referring now to FIG. 24, a perspective view of the azimuth adjustment assembly 150 and elevation adjustment assembly 190 of the sight alignment system 140 are shown. The azimuth adjustment assembly 150 is located between the optical sighting unit 145 and elevation trunnion assembly 210. The elevation adjustment assembly 190 is located at the mating intersection between sight v-flange 214 and the trunnion shaft outboard v-flange 215. In FIG. 24, the mating of the v-flanges is covered by lock band 216, which clamps the flanges in place.

Figure 25:
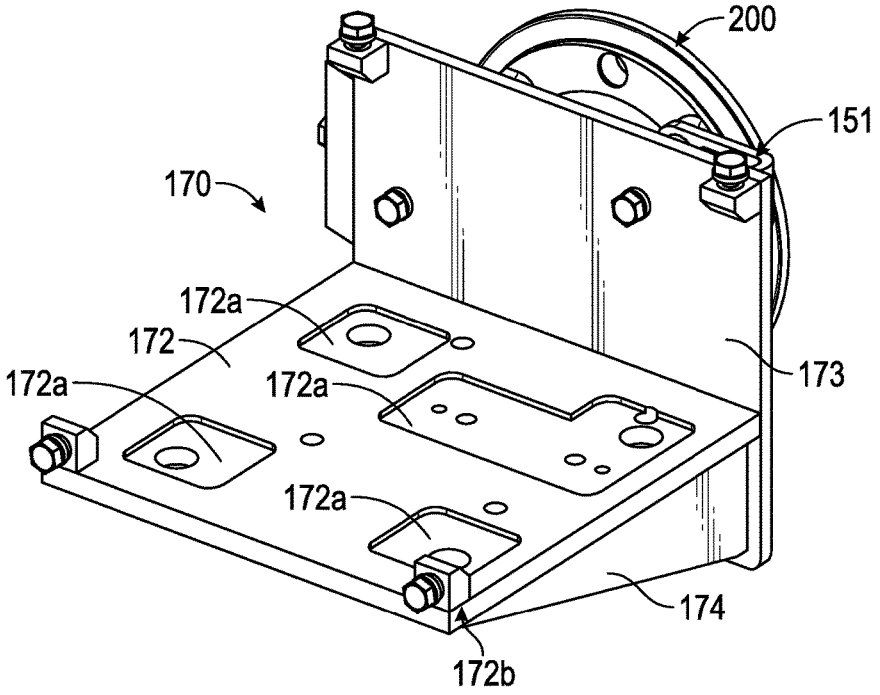
FIG. 25 is a detailed view of a support bracket that supports an optical sighting unit.

First, the azimuth adjustment assembly 150 will be described in greater detail. FIG. 25 is a perspective view of support bracket 170 of the optical sighting unit 145. In FIG. 25, the support bracket cover 171 and the optical sighting unit 145 are removed for clarity. The support bracket 170 includes three main components: a horizontal flat plate 172, a vertical flat plate 173, and angled support bracket 174.

Horizontal flat plate 172 is axially spaced and parallel to the roof of the turret 4. Horizontal flat plate 172 includes recessed portions 172*a*, which allows the optical sighting unit 145 to be firmly mounted onto horizontal flat plate 172. Horizontal flat plate 172 is connected to vertical flat plate 173, which is perpendicular to the roof of the turret 4. Because the optical sighting unit 145 extends from the elevation trunnion assembly 210 in a cantilever-like fashion, angled support bracket 174 is provided to support the weight of the optical sighting unit 145. The angled support bracket 174 is fixedly connected to the bottom of vertical flat plate 173, and extends in a tapered fashion to the distal end 172*b* of horizontal flat plate 172, where it is fixedly connected to the underside of horizontal flat plate 172.

Figure 26:
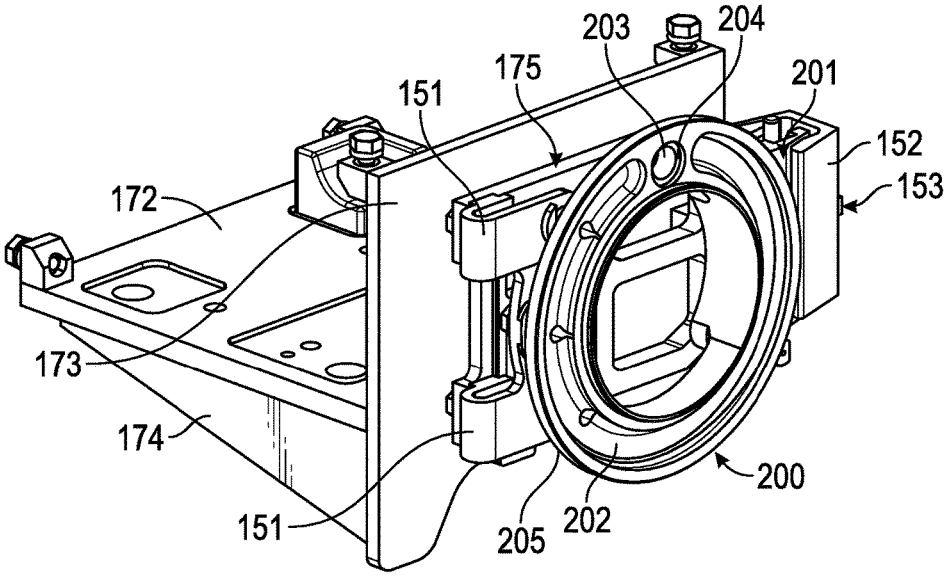
FIG. 26 is a perspective view of a support bracket with an azimuth adjustment assembly mounted thereon.

Referring now to FIG. 26, a perspective view of vertical flat plate 173 and azimuth adjustment assembly 150 is shown. An intermediate support bracket 175 attaches to vertical flat plate 173. The intermediate support bracket 175 is made of steel to provide strength to the azimuth adjustment assembly 150. On the other hand, horizontal flat plate 172, vertical flat plate 173, and angled support bracket 174 may be made of aluminum in an effort to make the overall weight of the support bracket 170 lighter in weight. The intermediate support bracket 175 is placed between the vertical flat plate 173 and an azimuth flex hinge 151.

Figure 27:
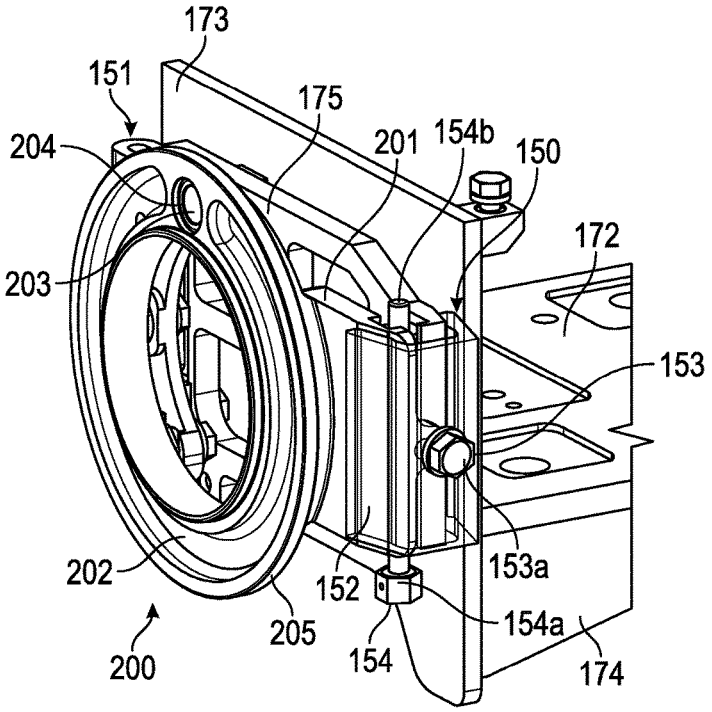
FIG. 27 is a perspective view of an azimuth adjustment assembly.

FIG. 27 is a perspective view of azimuth adjustment assembly 150. Clamping member 152 is shown securing intermediate support bracket 175 and extending portion 201 of the sight base disc 200 in place. Clamping member 152 is transparent in FIG. 27 for clarity. The Clamping member 152 secures the azimuth adjustment assembly 150 in place by wrapping around the intermediate support bracket 175 and the extending portion 201 of the sight base disc 200. An azimuth setting lock 153 with a hexagonal head 153*a* may be adjusted to tighten or loosen the Clamping member 152. The end portion 153*b* of the azimuth setting lock 153 may be threaded into extending portion 201 of the sight base disc 200. The azimuth setting lock 153 must be loosened in order to tighten or loosen azimuth adjustment screw 154, which will hereafter be described.

Referring still to FIG. 27, a perspective view of azimuth adjustment screw 154, which allows for fine tuning of the sight alignment system 140 in an azimuth plane. The azimuth adjustment screw 154 has a hexagonal head 154*a* and a non-threaded end portion 154*b*. The azimuth adjustment screw 154 and the azimuth setting lock 153 will hereafter be described in more detail.

Figure 28:
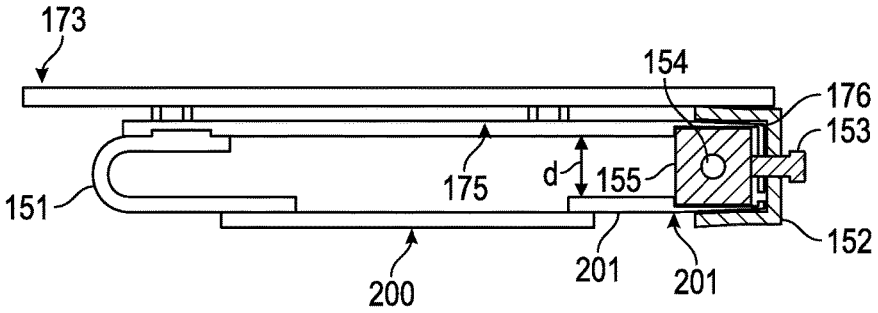
FIG. 28 is a top view of an azimuth adjustment assembly.

Referring now to FIG. 28, a top view of the azimuth adjustment assembly 150 is shown. Clamping member 152 clamps the intermediate support bracket 175 and the extending portion 201 of the sight base disc 200. The azimuth setting lock is shown threaded through the Clamping member 152 and the flange portion 176 of the intermediate support bracket 175 that wraps around the azimuth adjustment screw 154. A top wedge block 155 is shown surrounding the non-threaded end portion 154*b* of the azimuth adjustment screw 154 and fit in between the intermediate support bracket 175 and the extending portion 201 of the sight base disc 200. The goal of adjusting the azimuth adjustment screw 154 is to expand the distance d between the extending portion 201 of the sight base disc 200 and the intermediate support bracket 175, or alternatively, to narrow the distance d. Azimuth flex hinge 151 provides flexibility to the azimuth adjustment assembly 150 when the azimuth adjustment screw 154 is adjusted.

Figure 29:
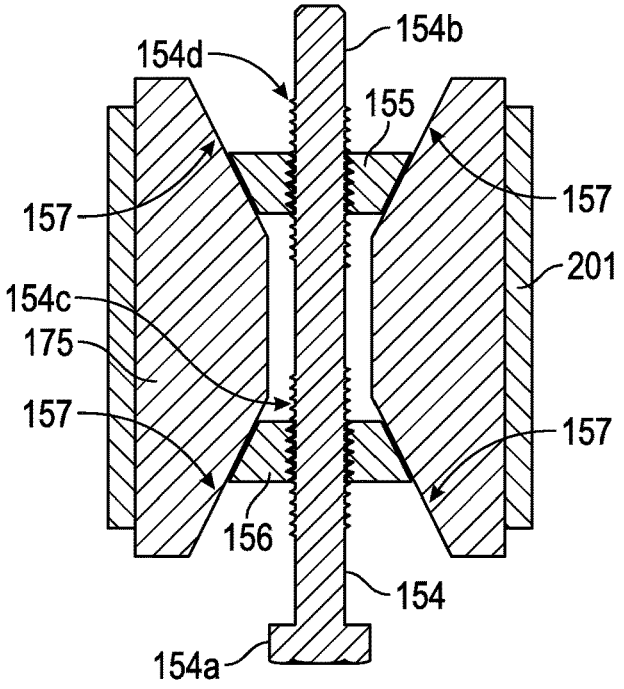
FIG. 29, taken on line A-A of FIG. 28, is a cross-sectional view of an azimuth adjustment screw.

FIG. 29, taken on line A-A of FIG. 28, is a cross-sectional view of the azimuth adjustment screw 154. The azimuth adjustment screw 154 is a turnbuckle-styled screw, meaning it has a helical right handed threaded portion 154*c* and a helical left handed threaded portion 154*d*. Both threaded portions of the azimuth adjustment screw 154 are external threads. The azimuth adjustment screw 154 is threaded into top wedge block 155 and a bottom wedge block 156. Both wedge blocks have internal helical threads that receive the external threads of the azimuth adjustment screw 154. The right handed threaded portion 154*c* and the left handed threaded portion 154*d* of the azimuth adjustment screw 154 are threaded into corresponding internal threaded portions of the wedge blocks. In this example, the top wedge block 155 has a left handed internal thread, while the bottom wedge block 156 has a right handed internal thread. Thus, the right handed threaded portion 154*c* of the azimuth adjustment screw 154 will be threaded into the bottom wedge block 156, and left handed threaded portion 154*d* of the azimuth adjustment screw 154 will be threaded into the top wedge block 155.

Figure 30A:
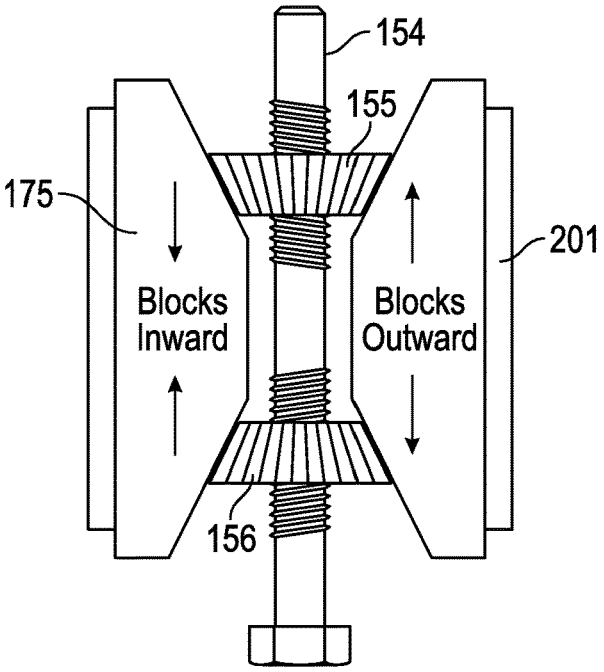
FIG. 30A illustrates the forces involved in increasing a distance d between an intermediate support bracket and an extending portion of a sight base disc.
Figure 30B:
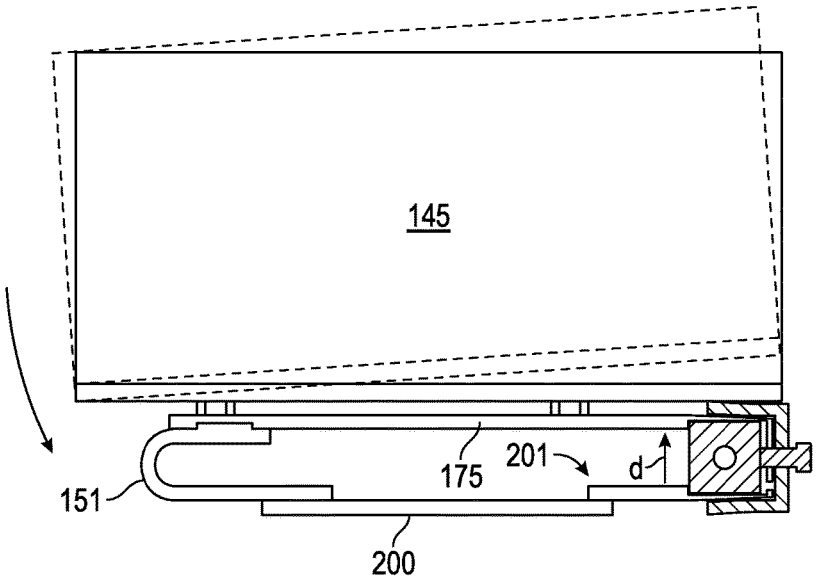
FIG. 30B is a top view of an azimuth adjustment assembly showing azimuth movement of an optical sighting unit when an azimuth adjustment screw is tightened.

As mentioned previously, when the hexagonal head 154*a* of the azimuth adjustment screw 154 is turned, the distance d may be either expanded or narrowed (increased or decreased) depending on the desired azimuth adjustment. For example, if the azimuth adjustment screw 154 is tightened to the right, or azimuth right, the bottom wedge block 156 is wedged further upward along inclined ramp 157. Simultaneously, top wedge block 155 is wedged further downward along the inclined ramp 157. The movement of these two blocks will be considered "blocks inward" in this example. FIG. 30A, taken on line A-A of FIG. 28, illustrates the "blocks inward" movement of the wedge blocks. In this example, the distance d is expanded or increased, which has the ultimate effect of adjusting the optical sighting unit 145 in a left azimuth direction. FIG. 30B illustrates the forces involved in expanding (increasing) the distance d between the intermediate support bracket 175 and the extending portion 201 of the sight base disc 200, which in turn causes the optical sighting unit 145 to rotate azimuth left.

Figure 30C:
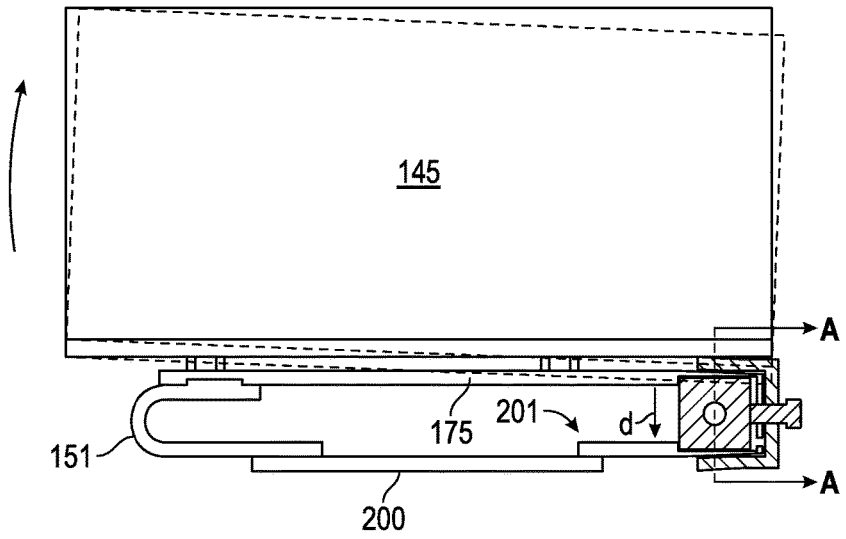
FIG. 30C is a top view of an azimuth adjustment assembly showing azimuth movement of an optical sighting unit when an azimuth adjustment screw is loosened.

Alternatively, if narrowing (decreasing) the distance d is desired, top wedge block 155 must move upward along the inclined ramp 157 and bottom wedge block 156 must move downward along inclined ramp 157, i.e., the wedge blocks must travel in a "blocks outward" motion. FIG. 30A, taken on line A-A of FIG. 28, illustrates the "blocks outward" movement of the wedge blocks. This may be accomplished by loosening the azimuth adjustment screw 154 to the left, or azimuth left. The result is an increased distance d between the intermediate support bracket 175 and the extending portion 201 of the sight base disc 200. FIG. 30C illustrates the forces involved in narrowing (decreasing) the distance d between the intermediate support bracket 175 and the extending portion 201 of the sight base disc 200, which in turn causes the optical sighting unit 145 to rotate azimuth right.

Second, the elevation adjustment assembly 190 will be described in greater detail. Referring again to FIG. 26, the sight base disc 200 is shown. The sight base disc 200 is fixedly attached to the azimuth flex hinge 151 via fasteners on one side, and is integral with an extending portion 201 of the sight base disc 200 on the opposite side. The sight base disc 200 includes an annular recessed portion 202 to assist with mating communication with trunnion shaft hub 211. Sight base disc 200 also includes pin bore 203, which receives an eccentric adjustment pin 220. Within the pin bore 203, there is a recessed bore portion 204 that helps position the eccentric adjustment pin 220 within the pin bore 203. The eccentric adjustment pin 220 may be rotated to adjust the elevation of the optical sighting unit 145.

Figure 31:
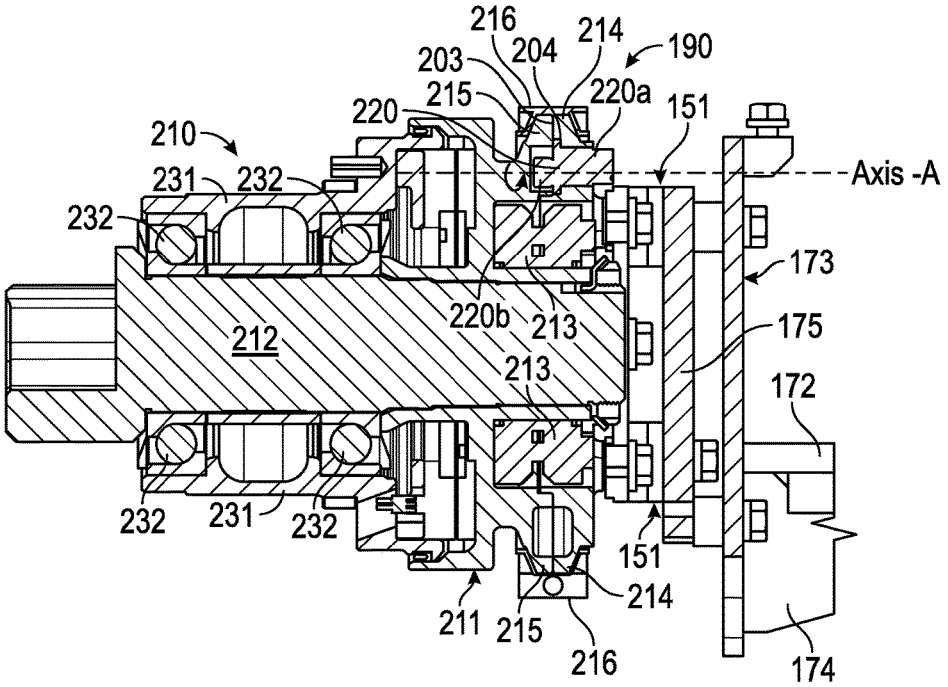
FIG. 31, taken on line B-B of FIG. 24, is a cross-sectional view of an elevation adjustment assembly.

FIG. 31, taken on line A-A of FIG. 24, is a cross-sectional view of the elevation adjustment assembly 190. Starting at the very right of FIG. 31, support bracket 170 is shown including horizontal flat plate 172, angled support bracket 174, and vertical flat plate 173. Moving left, the intermediate support bracket 175 is shown fixedly attached to vertical flat plate 173. The top and bottom portions of the azimuth flex hinge 151 are also fixedly attached to the sight base disc 200. The sight base disc 200 mates in a piloted fashion with trunnion shaft hub 211. Also shown in FIG. 31 is shrink clamp 213 that helps clamp trunnion shaft hub 211 to trunnion shaft 212.

The sight base disc 200 includes a sight v-flange 214 at the sight base disc's 200 outer periphery 205. The trunnion shaft hub 211 also includes a trunnion shaft outboard v-flange 215, which is in mating communication with the sight v-flange 214. As shown in FIG. 31, the eccentric adjustment pin 220 fits flush against the recessed bore portion 204 of the pin bore 203.

Elevation adjustment of the optical sighting unit 145 may be accomplished by adjusting the eccentric adjustment pin 220. When the eccentric adjustment pin 220 is adjusted, the sight base disc 200 rotates as well, causing the optical sighting unit 145 to rotate with respect to the elevation position of the commander's weapon 9. In other words, the sight base disc 200 may be adjusted to align the sight attitude relative to the attitude of the commander's weapon 9.

Before adjusting the eccentric adjustment pin 220, however, elevation lock band 216 must be removed. Elevation lock band 216 clamps the sight v-flange 214 of the sight base disc 200 with the outboard v-flange of the trunnion shaft hub 211 axially. After the elevation lock band 216 is removed, the hexagonal head 220*a* of the eccentric adjustment pin 220 may be rotated in a clockwise or counterclockwise direction, depending on the desired elevation adjustment. As the hexagonal head 220*a* of the eccentric adjustment pin 220 is rotated, eccentric portion 220*b* of the eccentric adjustment pin 220 is rotated about axial extending axis A-axis. The rotation of the eccentric adjustment pin 220 causes a rotation of the sight base disc 200; hence, the optical sighting unit 145 may be adjusted upward or downward in an elevation direction. After the eccentric adjustment pin 220 is adjusted such that the optical sighting unit 145 has the desired elevation relative to the commander's weapon 9, the sight v-flange 214 of the sight base disc 200 and the outboard v-flange of the trunnion shaft hub 211 must be realigned, and the elevation lock band 216 must clamp the elevation adjustment assembly 190 axially to keep it stabilized.

Figure 32:
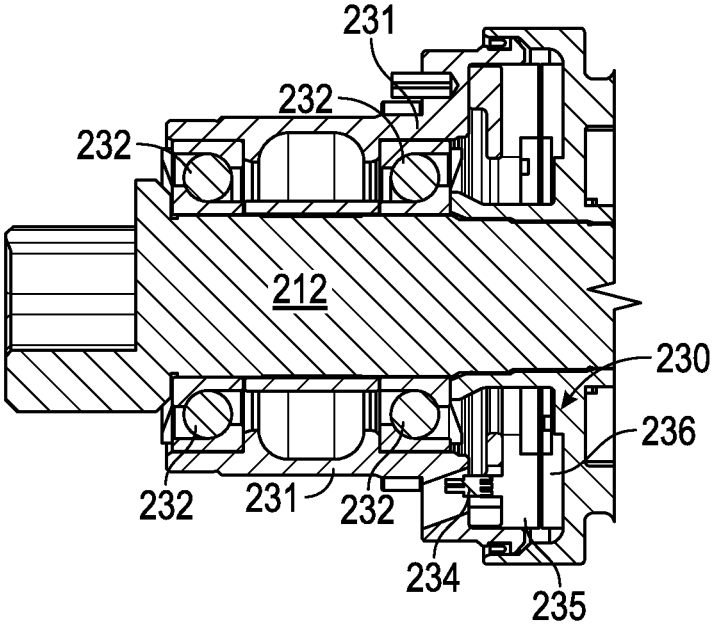
FIG. 32, taken on line B-B of FIG. 24, is a cross-sectional view of elevation position sensors.

Another embodiment of the SICWS 2 includes an elevation position sensor 230 and an azimuth position sensor 250. First, the elevation position sensor 230 will be discussed. Referring now to FIG. 32, a cross-sectional view taken on line B-B of FIG. 24, the location and components of the elevation position sensor 230 are shown. Starting from the left, a weapon trunnion shaft 212 is connected to the weapon cradle 111 (not shown). Surrounding and enclosing the weapon trunnion shaft 212 is stationary trunnion housing 231. The stationary trunnion housing 231 comprises trunnion bearings 232, which permit the trunnion shaft 212 to spin relative to the stationary trunnion housing 231. The elevation position sensor 230 is located at the mating of the stationary trunnion housing 231 and the trunnion shaft hub 211. The stationary trunnion housing 231 includes a position sensor cable path 233 that allows a sensor cable (not shown) to connect to sensor connector 234. The sensor connector 234 connects the sensor cable (not shown) to the position sensor stator 235, which is a rotary encoder. Position sensor stator 235 is stationary or fixed along with the stationary trunnion housing 231. Adjacent to the position sensor stator 235 is position sensor rotor 236, which rotates or spins along with the weapon trunnion shaft 212. The elevation position sensor 230 detects weapon elevation angle relative to the armored combat vehicle's 1 structure.

A similar sensor, the azimuth position sensor 250, is integral with the azimuth drive assembly 120, and located within the azimuth drive motor 124. Azimuth position sensor 250 is also a rotary encoder, much like elevation position sensor 230. The azimuth position sensor 250 permits the SICWS 2 to be readily aligned and engaged with distant targets in response to commands received from within the vehicle or from external network direction. One of ordinary skill in the art will appreciate that there may be more than one elevation position sensor 230 and more than one azimuth position sensor 250. In the event the armored combat vehicle 1 is damaged, redundant systems and sensors are one way to prevent the vehicle from complete loss of functionality.

The azimuth position sensor 250 and elevation position sensor 230 enable the SICWS 2 and the commander's weapon 9 to be rapidly and automatically aligned with the CITV 12 or the gunner's primary sight 13 upon command; or the commander may also command the main gun 6 to align the with the SICWS 2 and commander's weapon 9.

The above and other attributes combine to improve a commander's ability to visually survey the battlefield, maneuver the vehicle and accurately engage targets in powered, stabilized, or, in the event of electrical power loss, manual mode. Each of these modes of operation may be conducted with improved personal protection and relatively low profile for the vehicle. These features contribute to the significantly enhanced lethality and survivability of an armored combat vehicle 1 equipped with an SICWS 2.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed as new and desired to be protected by Letters Patent of the United States is:

1. A weapon station mountable on a vehicle having a base housing mounted concentrically with an operator ingress and egress the weapon station comprising: a low profile adapter mounted on said base housing and concentrically with said operator ingress and egress, said low profile adapter comprising a lower mounting surface connected to said base housing and an opposite upper mounting surface, said low profile adapter on said base housing further mounted over a periscope connected to said base housing, said lower mounting surface located vertically below an upper portion of said periscope and vertically above a lower portion of said periscope, said low profile adapter including a segmented structure extending from said lower mounting surface to said upper mounting surface and located directly behind and radially inward of said upper portion of said periscope, said low profile adapter configured to retain said upper portion of said periscope; and a rotating platform mounted on said upper mounting surface of said low profile adapter and concentrically with said operator ingress and egress, said rotating platform rotatable about an azimuth axis.

2. The weapon station of claim 1, wherein a Commander's Independent Thermal Viewer (CITV) is mounted on said vehicle, said CITV having an unobstructed 180 degree forward field of regard.

3. The weapon station of claim 1, wherein said weapon station may be operated in at least one of a power mode, a stabilized mode, and a manual mode.

4. The weapon station of claim 1, wherein said rotating platform may be driven about an azimuth axis in at least one of said power mode and said manual mode.

5. The weapon station of claim 1, wherein said low profile adapter includes multiple hand grips to assist an operator with ingress and egress from said operator ingress and egress.

6. The weapon station of claim 1, wherein said operator ingress and egress is a hatch opening of said armored combat vehicle.

7. The weapon station of claim 1, wherein said weapon station can be fired by an operator from said operator ingress and egress.

8. The weapon station of claim 1, wherein said segmented structure has a width equal or greater than a width of said upper portion of said periscope.

9. The weapon station of claim 1, wherein said upper mounting surface is located vertically above said upper portion of said periscope.

10. A weapon station mountable on a structure having an operator ingress and egress, said weapon station comprising:

a low profile adapter mounted on said structure and concentrically with said operator ingress and egress, said low profile adapter comprising a lower mounting surface connected to said structure and an opposite upper mounting surface, said low profile adapter further comprising a segmented structure extending from said lower mounting surface to said upper mounting surface and located directly behind and radially inward of a periscope connected to said structure, said lower mounting surface located vertically below an upper portion of said periscope and vertically above a lower portion of said periscope;

a rotating platform mounted on said upper mounting surface of said low profile adapter and concentrically with said operator ingress and egress, said rotating platform rotatable about an azimuth axis;

a weapon mounted on said rotating platform, said weapon capable of being operated in at least one of a power mode, a stabilized mode, and a manual mode; and wherein said weapon is capable of being fired in said manual mode by an operator without leaving said operator ingress and egress.

11. The weapon station of claim 10, wherein a Commander's Independent Thermal Viewer (CITV) is mounted on said structure, said CITV having an unobstructed 180 degree forward field of regard.

12. The weapon station of claim 10, wherein said rotating platform may be driven about an azimuth axis in at least one of said power mode and said manual mode.

13. The weapon station of claim 10, wherein said low profile adapter is configured to retain said periscope.

14. The weapon station of claim 10, wherein said low profile adapter further comprises two or more segmented sections forming a continuous uninterrupted ring.

15. A method for mounting a weapon station on a structure having an operator ingress and egress and at least one optical sight with a line of sight (LOS), comprising the steps of:

mounting a low profile adapter to said structure, said low profile adapter comprising a lower mounting surface and an opposite upper mounting surface, said lower mounting surface mounted on a base housing above said structure, said base housing configured to retain a lower portion of said at least one optical sight, said low profile adapter further comprising a segmented structure extending from said lower mounting surface to said upper mounting surface and located directly behind and radially inward of said at least one optical sight connected to said structure, said lower mounting surface located vertically below an upper portion of said at least one optical sight and vertically above a lower portion of said at least one optical sight, wherein the at least one optical sight is an array of one or more periscopes having said LOS, wherein said weapon station does not obstruct said LOS through any periscopes of said array of one or more periscopes, said low profile adapter mounted concentrically with said operator ingress and egress; and mounting a rotating platform on said upper mounting surface of said low profile adapter and concentrically with said operator ingress and egress, said rotating platform having a weapon cradle for retaining a weapon, said rotating platform rotatable about an azimuth axis.

16. The method of claim 15, wherein an operator can fire said weapon from said operator ingress and egress.

17. The weapon station of claim 8, wherein said low profile adapter further comprises a first undersurface mount and a second undersurface mount spaced from said first undersurface mount, said first and second undersurface mounts extending radially outward from said lower mounting surface and spaced from said upper mounting surface, said first and second under surface mounts located on respective opposite sides of said periscope.

18. The weapon station of claim 17, wherein said segmented structure is directly connected to said first and second undersurface mounts.

19. The weapon station of claim 17, wherein said periscope includes an array of two or more periscopes, at least one of said first and second undersurface mounts located between and spaced from adjacent periscopes of said two or more periscopes.

20. The weapon station of claim 17, wherein said low profile adapter further comprises two or more segmented sections forming a continuous uninterrupted ring.

* * * * *